US008939312B1

(12) United States Patent
Buck

(10) Patent No.: US 8,939,312 B1
(45) Date of Patent: Jan. 27, 2015

(54) CONTAINER LID SYSTEM WITH A LID PORTION AND FOOD CONTAINER PORTION

(71) Applicant: Ronald Mark Buck, Encinitas, CA (US)

(72) Inventor: Ronald Mark Buck, Encinitas, CA (US)

(73) Assignee: Top-That! LLC, Encinitas, CA (US)

( * ) Notice: Subject to any disclaimer, the term of this patent is extended or adjusted under 35 U.S.C. 154(b) by 0 days.

(21) Appl. No.: 14/313,907

(22) Filed: Jun. 24, 2014

Related U.S. Application Data

(60) Provisional application No. 62/005,862, filed on May 30, 2014.

(51) Int. Cl.
*A47G 19/22* (2006.01)

(52) U.S. Cl.
CPC ..... *A47G 19/2205* (2013.01); *A47G 19/2222* (2013.01)
USPC ..... 220/521; 220/212; 220/709

(58) Field of Classification Search
CPC ..... B65D 81/3205; B65D 81/32; B65D 81/3261; B65D 51/28; B65D 51/24; A47G 19/2222
USPC ..... 220/522, 521, 709, 705, 212.5, 212, 220/528; 206/514, 508, 217, 216, 546, 541, 206/223; 215/388, 229, 228, 387
See application file for complete search history.

(56) References Cited

U.S. PATENT DOCUMENTS

| | | | |
|---|---|---|---|
| 34,976 | A | 4/1862 | Nicholson |
| 36,131 | A | 8/1862 | Zettle |
| 602,791 | A | 4/1898 | Wurzburg |
| 674,305 | A | 5/1901 | Patterson |
| 681,871 | A | 9/1901 | Burdick |
| 726,321 | A | 4/1903 | Mason |
| 730,903 | A | 6/1903 | Gibson |
| 824,341 | A | 6/1906 | Cordes |

(Continued)

FOREIGN PATENT DOCUMENTS

| | | | |
|---|---|---|---|
| AU | 2009250333 | | 11/2009 |
| EP | 0064047 | A1 | 4/1982 |

(Continued)

OTHER PUBLICATIONS

Internationa Search Report and Written Opinion issued in PCT/US2012/054032 on Mar. 19, 2013.

(Continued)

*Primary Examiner* — Robert J Hicks
(74) *Attorney, Agent, or Firm* — Manuel de la Cerra

(57) ABSTRACT

A container lid system is provided. The lid system may be constructed of two parts: a lid portion and a food container portion. A top cover may also be used. The food container portion may employ a condiment receiving structure that receives a condiment package/container or an unpackaged condiment. The container lid system allows a user to consume food items while the food container portion is coupled to a cup lid or alternatively the food container portion may be decoupled and placed on a table. The cross sections of the lid portion and the food container portion are substantially complementary to each other, such that the food container portion may snuggly mate with the lid portion. Thermoforming may be used to create each of the three parts, and the parts may snap-fit together. Different materials may be used for the parts including black opaque plastic, white opaque plastic and clear plastic.

21 Claims, 24 Drawing Sheets

(56) References Cited

U.S. PATENT DOCUMENTS

| | | | | |
|---|---|---|---|---|
| 873,867 | A | | 12/1907 | Kirkgaard |
| 930,938 | A | | 8/1909 | Clement |
| 1,002,963 | A | | 9/1911 | Bostwick |
| 1,331,336 | A | | 2/1920 | Fisher |
| 1,395,594 | A | | 11/1921 | Pfefferle |
| 1,434,831 | A | | 11/1922 | Long |
| 1,441,742 | A | | 1/1923 | O'Brien |
| 1,482,931 | A | | 2/1924 | Keehn |
| 1,485,136 | A | | 2/1924 | House |
| 1,545,227 | A | | 7/1925 | Baltzley |
| 1,600,758 | A | | 9/1926 | Goldstein |
| 1,609,453 | A | | 12/1926 | Atwood |
| 1,665,289 | A | | 4/1928 | Weaver |
| 1,713,676 | A | | 5/1929 | Rose |
| 1,755,042 | A | | 4/1930 | Zoller |
| 1,773,972 | A | | 8/1930 | Eberhart |
| 1,862,620 | A | | 6/1932 | Graham |
| 1,948,920 | A | | 2/1934 | Johnson |
| 1,965,713 | A | | 7/1934 | Shaw |
| 1,985,181 | A | | 12/1934 | Matthews |
| 1,985,258 | A | | 12/1934 | Mauser |
| 1,985,998 | A | | 1/1935 | Koch et al. |
| 2,003,657 | A | | 6/1935 | Stabblefield |
| 2,015,028 | A | | 9/1935 | Gillette |
| 2,045,480 | A | | 6/1936 | Magnesen et al. |
| 2,050,487 | A | | 8/1936 | Durrant |
| 2,120,403 | A | | 6/1938 | Godfrey |
| 2,121,843 | A | | 6/1938 | Vaughn |
| 2,142,590 | A | | 1/1939 | Smith |
| 2,148,468 | A | | 2/1939 | Hothersall |
| 2,174,618 | A | | 10/1939 | Burdick |
| 2,191,705 | A | | 2/1940 | Chamberlain |
| 2,205,685 | A | | 6/1940 | Conner |
| 2,241,044 | A | | 5/1941 | Knut |
| 2,271,589 | A | | 2/1942 | Hendrickson |
| 2,276,678 | A | | 3/1942 | Wheeler |
| 2,327,077 | A | | 8/1943 | Teetor |
| 2,328,543 | A | | 9/1943 | Bauman |
| 2,339,343 | A | | 1/1944 | Magnesen |
| 2,374,092 | A | | 4/1945 | Glaser |
| 2,375,643 | A | | 5/1945 | Sermanotta |
| 2,421,356 | A | | 5/1947 | Saffady |
| 2,461,908 | A | | 2/1949 | Magnesen |
| 2,484,039 | A | | 10/1949 | Krueger |
| 2,545,979 | A | | 3/1951 | Tregear |
| 2,649,984 | A | | 8/1953 | Abt |
| 2,665,023 | A | | 1/1954 | Migneault |
| 2,671,572 | A | | 3/1954 | Staz |
| 2,748,976 | A | | 6/1956 | Magnesen |
| 2,753,050 | A | | 7/1956 | Langston |
| 2,760,674 | A | | 8/1956 | Karp |
| 2,766,796 | A | | 10/1956 | Tupper |
| 2,816,687 | A | | 12/1957 | Phillips |
| 2,920,804 | A | | 1/1960 | Minton |
| 2,931,230 | A | * | 4/1960 | Lowery ..... 73/427 |
| 2,965,496 | A | | 12/1960 | Serdar |
| 2,977,019 | A | | 3/1961 | Henchert |
| 2,982,440 | A | | 5/1961 | Harrison |
| 3,045,859 | A | | 7/1962 | McMahon |
| 3,045,887 | A | | 7/1962 | Caine |
| 3,064,800 | A | | 11/1962 | Hart |
| 3,070,275 | A | | 12/1962 | Bostrom |
| 3,071,281 | A | | 1/1963 | Sawai |
| 3,085,710 | A | | 4/1963 | McIlroy |
| 3,138,432 | A | | 6/1964 | Kleinhans |
| RE25,618 | E | | 7/1964 | Goodman |
| 3,157,335 | A | | 11/1964 | Maier |
| 3,163,308 | A | | 12/1964 | Friedell |
| 3,170,591 | A | | 2/1965 | Ullman et al. |
| 3,185,341 | A | | 5/1965 | Barbour |
| 3,187,919 | A | | 6/1965 | Inglis |
| 3,194,468 | A | | 7/1965 | Baron |
| 3,244,420 | A | | 4/1966 | Poynter |
| 3,245,691 | A | | 4/1966 | Gorman |
| 3,269,734 | A | | 8/1966 | Ottofy |
| 3,285,462 | A | | 11/1966 | Bulmer et al. |
| 3,288,344 | A | | 11/1966 | Woollen et al. |
| 3,323,706 | A | | 6/1967 | Gereke |
| 3,325,048 | A | | 6/1967 | Edwards |
| 3,327,895 | A | | 6/1967 | Mueller |
| 3,349,941 | A | | 10/1967 | Wanderer |
| 3,369,687 | A | | 2/1968 | Walls |
| 3,384,265 | A | | 5/1968 | Frank |
| 3,397,867 | A | | 8/1968 | Hoff |
| 3,401,825 | A | | 9/1968 | Weiss |
| 3,413,128 | A | | 11/1968 | Steinbarth et al. |
| 3,420,399 | A | | 1/1969 | Heisler |
| 3,421,653 | A | | 1/1969 | Whaley |
| 3,421,654 | A | | 1/1969 | Gunter |
| 3,421,681 | A | | 1/1969 | Frank |
| 3,425,580 | A | | 2/1969 | Brockhage |
| 3,433,378 | A | | 3/1969 | Ross |
| 3,439,841 | A | | 4/1969 | Irving |
| 3,447,710 | A | | 6/1969 | Blair |
| 3,456,860 | A | | 7/1969 | Janninck |
| 3,495,733 | A | | 2/1970 | Davis |
| 3,514,029 | A | | 5/1970 | Powell |
| 3,515,306 | A | | 6/1970 | Roper et al. |
| 3,532,244 | A | | 10/1970 | Yates, Jr. |
| 3,557,995 | A | | 1/1971 | Mirasol, Jr. et al. |
| 3,561,668 | A | | 2/1971 | Bergstrom |
| 3,580,468 | A | | 5/1971 | McDevitt |
| 3,598,271 | A | | 8/1971 | Holley |
| 3,603,473 | A | | 9/1971 | Winberg |
| 3,606,262 | A | | 9/1971 | Hoff |
| 3,616,897 | A | | 11/1971 | Vrana |
| 3,616,955 | A | | 11/1971 | Heffran |
| 3,624,787 | A | | 11/1971 | Newman |
| 3,674,512 | A | | 7/1972 | Andros |
| 3,679,089 | A | | 7/1972 | Swett et al. |
| 3,696,987 | A | | 10/1972 | Schuff |
| D226,063 | S | | 1/1973 | Warnberg |
| 3,734,276 | A | | 5/1973 | Bank |
| 3,743,520 | A | | 7/1973 | Croner |
| 3,745,055 | A | | 7/1973 | Gorman |
| 3,746,158 | A | | 7/1973 | Connick |
| 3,765,559 | A | | 10/1973 | Sauey |
| 3,768,688 | A | | 10/1973 | Linke |
| 3,769,056 | A | | 10/1973 | Sincock |
| 3,770,156 | A | | 11/1973 | Yates, Jr. |
| 3,774,797 | A | | 11/1973 | Vliet |
| 3,784,052 | A | | 1/1974 | Edwards |
| 3,792,893 | A | | 2/1974 | Grotnes |
| 3,796,813 | A | | 3/1974 | Kurland |
| 3,797,696 | A | | 3/1974 | Dibrell |
| 3,806,023 | A | | 4/1974 | Barnett |
| 3,815,281 | A | | 6/1974 | Kander |
| 3,817,419 | A | | 6/1974 | Moller et al. |
| 3,820,684 | A | | 6/1974 | Harrison |
| 3,822,030 | A | | 7/1974 | Tanzer |
| 3,858,756 | A | | 1/1975 | Fulton |
| 3,868,043 | A | | 2/1975 | Freemyer |
| 3,874,554 | A | | 4/1975 | Chang |
| 3,877,581 | A | | 4/1975 | Auxer |
| 3,880,288 | A | | 4/1975 | Hunter |
| 3,910,414 | A | | 10/1975 | McCay |
| 3,942,679 | A | | 3/1976 | Starr |
| RE28,797 | E | | 5/1976 | Brewer |
| 3,963,140 | A | | 6/1976 | Harding |
| 3,974,931 | A | | 8/1976 | Moller |
| 4,003,488 | A | | 1/1977 | Moller |
| 4,007,936 | A | | 2/1977 | Hornsby, Jr. |
| 4,009,805 | A | | 3/1977 | Klygis et al. |
| 4,018,355 | A | | 4/1977 | Ando |
| 4,027,779 | A | | 6/1977 | De Long |
| 4,036,392 | A | | 7/1977 | Martin |
| 4,049,122 | A | | 9/1977 | Maxwell |
| 4,054,205 | A | | 10/1977 | Blow, Jr. et al. |
| 4,056,210 | A | | 11/1977 | Boyle |
| 4,074,827 | A | | 2/1978 | Labe, III |
| 4,091,953 | A | | 5/1978 | Daenen |
| 4,106,660 | A | | 8/1978 | Boyle |
| 4,119,239 | A | | 10/1978 | Anderson |
| 4,141,462 | A | | 2/1979 | Rucci |

(56) References Cited

U.S. PATENT DOCUMENTS

| | | | |
|---|---|---|---|
| 4,146,157 | A | 3/1979 | Dixon et al. |
| 4,183,444 | A | 1/1980 | English |
| 4,183,446 | A | 1/1980 | Davis |
| 4,186,842 | A | 2/1980 | Albert |
| 4,206,845 | A | 6/1980 | Christian |
| 4,234,100 | A | 11/1980 | Chabot |
| 4,264,007 | A | 4/1981 | Hunt |
| 4,279,353 | A | 7/1981 | Honma |
| 4,318,500 | A | 3/1982 | Melikian |
| 4,340,138 | A | 7/1982 | Bernhardt |
| 4,350,260 | A | 9/1982 | Prueher |
| 4,380,307 | A | 4/1983 | Stillinger |
| 4,389,802 | A | 6/1983 | McLaren et al. |
| 4,390,113 | A | 6/1983 | Bird |
| 4,407,426 | A | 10/1983 | McLaren et al. |
| 4,423,822 | A | 1/1984 | Powalowski |
| 4,438,865 | A | 3/1984 | Scattaregia |
| 4,441,623 | A | 4/1984 | Antoniak |
| 4,446,969 | A | 5/1984 | Tyler |
| 4,458,584 | A | 7/1984 | Annese et al. |
| 4,478,346 | A | 10/1984 | Spong |
| 4,487,114 | A | 12/1984 | Abdenour |
| 4,489,848 | A | 12/1984 | Braudf |
| 4,491,220 | A | 1/1985 | Daviss |
| 4,503,992 | A | 3/1985 | Sitko et al. |
| 4,518,096 | A | 5/1985 | Winstead |
| 4,564,116 | A | 1/1986 | Prohaska |
| 4,566,605 | A | 1/1986 | Rogers |
| 4,589,569 | A | 5/1986 | Clements |
| D285,656 | S | 9/1986 | Champion |
| 4,619,372 | A | 10/1986 | McFarland |
| 4,625,890 | A | 12/1986 | Galer |
| 4,627,537 | A | 12/1986 | Rogers |
| 4,629,084 | A | 12/1986 | Hackelsberger |
| D289,720 | S | 5/1987 | Maher |
| D290,323 | S | 6/1987 | Weernink |
| 4,699,299 | A | 10/1987 | Gach |
| 4,717,037 | A | 1/1988 | Van Der Meulen |
| 4,718,788 | A | 1/1988 | Briscoe |
| 4,728,003 | A | 3/1988 | Davey |
| 4,732,274 | A | 3/1988 | Bouton |
| 4,735,337 | A | 4/1988 | Von Holdt |
| 4,738,373 | A | 4/1988 | DeParales |
| D296,874 | S | 7/1988 | Dallas |
| D297,799 | S | 9/1988 | Hammer |
| 4,782,976 | A | 11/1988 | Kenyon, II |
| 4,785,931 | A | 11/1988 | Weir et al. |
| 4,789,076 | A | 12/1988 | Jewitt et al. |
| 4,795,052 | A | 1/1989 | Hayes, Jr. |
| 4,807,776 | A | 2/1989 | Cortopassi |
| 4,823,958 | A | 4/1989 | Mahmud |
| D303,194 | S | 9/1989 | Darby et al. |
| 4,872,569 | A | 10/1989 | Bolte |
| 4,872,586 | A | 10/1989 | Landis |
| 4,877,151 | A | 10/1989 | Rush et al. |
| 4,901,881 | A | 2/1990 | McElroy |
| 4,906,158 | A | 3/1990 | Dewitt et al. |
| 4,938,373 | A | 7/1990 | McKee |
| 4,944,102 | A | 7/1990 | Behlendorf et al. |
| 4,966,294 | A | 10/1990 | Mack |
| 4,971,211 | A | 11/1990 | Lake |
| D318,427 | S | 7/1991 | Sherburne, Jr. |
| 5,027,972 | A | 7/1991 | Bartholomew |
| 5,035,320 | A | 7/1991 | Pione |
| 5,046,632 | A | 9/1991 | Bordner |
| 5,052,553 | A | 10/1991 | DeSanctis |
| 5,054,642 | A | 10/1991 | Yoshida |
| 5,058,737 | A | 10/1991 | Patterson et al. |
| 5,060,820 | A | 10/1991 | Boerner |
| 5,064,082 | A | 11/1991 | Lombardi et al. |
| D323,116 | S | 1/1992 | Dart et al. |
| 5,085,330 | A | 2/1992 | Paulin |
| 5,090,584 | A | 2/1992 | Roberts et al. |
| D324,973 | S | 3/1992 | Stagerman |
| 5,099,232 | A | 3/1992 | Howes |
| 5,137,210 | A | 8/1992 | Hibbs |
| 5,145,646 | A | 9/1992 | Tyranski |
| 5,176,283 | A | 1/1993 | Patterson et al. |
| 5,180,079 | A | 1/1993 | Jeng |
| D334,958 | S | 4/1993 | Fischer |
| 5,207,743 | A | 5/1993 | Costarella et al. |
| 5,234,125 | A | 8/1993 | Roberts |
| 5,240,136 | A | 8/1993 | Patterson et al. |
| D339,027 | S | 9/1993 | Mack |
| 5,246,133 | A | 9/1993 | James |
| 5,249,700 | A | 10/1993 | Dumke |
| 5,283,140 | A | 2/1994 | Netz et al. |
| 5,292,028 | A | 3/1994 | Patterson et al. |
| 5,294,000 | A | 3/1994 | Yanuzzi |
| 5,310,072 | A | 5/1994 | Matusovsky et al. |
| 5,318,787 | A | 6/1994 | Brauner |
| 5,325,982 | A | 7/1994 | Cobb, Jr. |
| 5,346,070 | A | 9/1994 | McSpadden |
| 5,346,095 | A | 9/1994 | Deal |
| 5,366,089 | A | 11/1994 | Parker |
| 5,366,104 | A | 11/1994 | Armstrong |
| 5,375,828 | A | 12/1994 | Shikami |
| 5,377,860 | A | 1/1995 | Littlejohn et al. |
| 5,381,901 | A | 1/1995 | Hundley |
| 5,385,255 | A | 1/1995 | Varano et al. |
| D355,735 | S | 2/1995 | Shaffer et al. |
| 5,388,729 | A | 2/1995 | Gerringer |
| 5,390,798 | A | 2/1995 | Yanuzzi |
| 5,392,949 | A | 2/1995 | McKenna |
| 5,393,258 | A | 2/1995 | Karterman |
| 5,397,023 | A | 3/1995 | Toczek et al. |
| 5,402,903 | A | 4/1995 | Mann |
| D358,294 | S | 5/1995 | Letica |
| 5,415,312 | A | 5/1995 | Mueller |
| 5,417,364 | A | 5/1995 | Shaw |
| 5,429,262 | A | 7/1995 | Sharkey |
| 5,431,276 | A | 7/1995 | Lialin |
| D361,469 | S | 8/1995 | Young |
| 5,441,164 | A | 8/1995 | Beck et al. |
| 5,449,089 | A | 9/1995 | Turner |
| D362,801 | S | 10/1995 | Milroy |
| 5,464,150 | A | 11/1995 | Porres Sanchez et al. |
| 5,489,026 | A | 2/1996 | D'Aloia |
| 5,490,609 | A | 2/1996 | Lane et al. |
| 5,503,858 | A | 4/1996 | Reskow |
| D370,412 | S | 6/1996 | Rohrer |
| 5,524,788 | A | 6/1996 | Plester |
| 5,524,817 | A | 6/1996 | Meier et al. |
| 5,529,179 | A | 6/1996 | Hanson |
| 5,531,347 | A | 7/1996 | Goulding |
| 5,538,154 | A | 7/1996 | Von Holdt |
| 5,540,333 | A | 7/1996 | Gonzalez et al. |
| 5,540,349 | A | 7/1996 | Philips |
| D372,866 | S | 8/1996 | Ahern, Jr. |
| 5,542,532 | A | 8/1996 | Mitchell |
| 5,573,131 | A | 11/1996 | Berjis |
| 5,573,133 | A | 11/1996 | Park |
| D376,311 | S | 12/1996 | Burton |
| 5,587,192 | A | 12/1996 | Beizermann |
| 5,592,766 | A | 1/1997 | Mygatt |
| 5,593,062 | A | 1/1997 | Martin |
| 5,624,053 | A | 4/1997 | Freek et al. |
| 5,641,063 | A | 6/1997 | Gambardella et al. |
| 5,647,499 | A | 7/1997 | Piazza |
| D381,866 | S | 8/1997 | St. Gelais |
| 5,657,898 | A | 8/1997 | Portman et al. |
| D383,944 | S | 9/1997 | Lillelund |
| 5,662,240 | A | 9/1997 | Norris |
| D384,580 | S | 10/1997 | Fernandes et al. |
| 5,678,720 | A | 10/1997 | Van Melle |
| 5,685,449 | A | 11/1997 | Oblak |
| 5,695,052 | A | 12/1997 | Damato |
| 5,695,084 | A | 12/1997 | Chmela et al. |
| 5,697,509 | A | 12/1997 | Hayes |
| 5,699,927 | A | 12/1997 | Lane et al. |
| 5,705,210 | A | 1/1998 | Sillince et al. |
| 5,713,463 | A | 2/1998 | Lakoski et al. |
| 5,720,555 | A | 2/1998 | Elele |
| 5,722,558 | A | 3/1998 | Thompson |

(56) References Cited

U.S. PATENT DOCUMENTS

| | | | |
|---|---|---|---|
| 5,725,117 | A | 3/1998 | Berjis |
| 5,725,122 | A | 3/1998 | Murphy et al. |
| 5,727,678 | A | 3/1998 | Chen |
| D393,397 | S | 4/1998 | Lillelund |
| 5,743,423 | A | 4/1998 | Franco |
| 5,746,312 | A | 5/1998 | Johnson |
| 5,769,263 | A | 6/1998 | Willingham et al. |
| 5,775,570 | A | 7/1998 | Kim |
| D397,911 | S | 9/1998 | Waldmann |
| 5,806,707 | A | 9/1998 | Boehm et al. |
| 5,829,583 | A | 11/1998 | VerWeyst et al. |
| 5,839,601 | A | 11/1998 | Van Melle |
| 5,875,957 | A | 3/1999 | Yocum |
| 5,894,952 | A | 4/1999 | Mendenhall et al. |
| 5,904,266 | A | 5/1999 | Tedeschi |
| 5,911,331 | A | 6/1999 | Boller |
| 5,934,493 | A | 8/1999 | Han |
| 5,947,319 | A | 9/1999 | Sinski |
| 5,954,195 | A | 9/1999 | Krueger et al. |
| 5,971,195 | A | 10/1999 | Reidinger et al. |
| 5,979,647 | A | 11/1999 | Han |
| 5,984,131 | A | 11/1999 | Krueger |
| 5,992,061 | A | 11/1999 | Fleck et al. |
| D417,845 | S | 12/1999 | Sadlier et al. |
| 5,996,832 | A | 12/1999 | Nieuwoudt |
| 6,003,671 | A | 12/1999 | McDonough et al. |
| 6,065,628 | A | 5/2000 | Page |
| 6,079,586 | A | 6/2000 | Hanneman |
| 6,079,587 | A | 6/2000 | Vogt |
| 6,085,919 | A | 7/2000 | Singer |
| 6,109,518 | A | 8/2000 | Mueller et al. |
| 6,112,891 | A | 9/2000 | Wohl et al. |
| 6,119,884 | A | 9/2000 | Lowry |
| 6,119,889 | A | 9/2000 | Fujii et al. |
| 6,119,930 | A | 9/2000 | Lunstra et al. |
| 6,164,485 | A | 12/2000 | Hilton |
| 6,176,390 | B1 | 1/2001 | Kemp |
| 6,202,542 | B1 | 3/2001 | Melton |
| 6,209,234 | B1 | 4/2001 | Meyers |
| 6,209,748 | B1 | 4/2001 | Dunbar |
| 6,230,969 | B1 | 5/2001 | Spransy |
| 6,263,923 | B1 | 7/2001 | Castillo |
| 6,296,141 | B1 | 10/2001 | Lukacevic |
| 6,299,014 | B1 | 10/2001 | Nava et al. |
| 6,311,860 | B1 | 11/2001 | Reidinger et al. |
| 6,311,865 | B1 | 11/2001 | Laurent |
| 6,314,866 | B1 | 11/2001 | Melton |
| D453,107 | S | 1/2002 | Wyslotsky et al. |
| 6,338,417 | B1 | 1/2002 | Ferraro |
| 6,354,190 | B1 | 3/2002 | Haydon |
| 6,360,885 | B1 | 3/2002 | Krueger |
| 6,364,102 | B1 | 4/2002 | Gordon et al. |
| 6,375,023 | B1 | 4/2002 | Lecinski et al. |
| 6,382,449 | B1 | 5/2002 | Kazmierski et al. |
| 6,394,297 | B1 | 5/2002 | Nance |
| 6,412,526 | B2 | 7/2002 | Castillo |
| 6,425,480 | B1 | 7/2002 | Krueger et al. |
| 6,427,864 | B1 | 8/2002 | Asselin |
| 6,464,099 | B1 | 10/2002 | Portman et al. |
| 6,471,119 | B2 | 10/2002 | Cai |
| 6,474,494 | B1 | 11/2002 | Miller |
| 6,488,173 | B2 | 12/2002 | Milan |
| 6,528,105 | B1 | 3/2003 | Gerhart et al. |
| D473,463 | S | 4/2003 | Armstrong |
| 6,557,698 | B2 | 5/2003 | Gordon |
| 6,641,854 | B2 | 11/2003 | Gerhart |
| 6,648,164 | B1 | 11/2003 | DeCola et al. |
| 6,652,435 | B1 | 11/2003 | Sand |
| 6,679,397 | B2 | 1/2004 | Smith et al. |
| 6,706,297 | B1 | 3/2004 | Toth et al. |
| 6,708,735 | B1 | 3/2004 | Kenihan |
| 6,726,946 | B1 | 4/2004 | Smith |
| 6,766,902 | B1 | 7/2004 | Hartelius |
| 6,793,075 | B1 | 9/2004 | Jeter |
| 6,814,250 | B1 | 11/2004 | Madsen |
| 6,860,397 | B1 | 3/2005 | Walters, Jr. |
| 6,915,901 | B2 | 7/2005 | Feinberg et al. |
| D508,819 | S | 8/2005 | Mangla |
| 6,932,231 | B2 | 8/2005 | Haynes |
| 7,063,229 | B2 | 6/2006 | Westerhof et al. |
| 7,111,748 | B2 | 9/2006 | Cha |
| 7,159,732 | B2 | 1/2007 | Smith et al. |
| 7,175,042 | B2 | 2/2007 | Durdon |
| 7,182,242 | B2 | 2/2007 | Cai |
| 7,217,434 | B1 | 5/2007 | Loh et al. |
| D559,035 | S | 1/2008 | Hayes |
| 7,341,754 | B1 | 3/2008 | Loh |
| 7,387,063 | B2 | 6/2008 | Vu et al. |
| D590,662 | S | 4/2009 | Cheng |
| 7,568,586 | B2 | 8/2009 | Walters, Jr. |
| 7,588,275 | B2 | 9/2009 | Borg |
| 7,594,584 | B2 | 9/2009 | Durdon et al. |
| 7,699,216 | B2 | 4/2010 | Smith et al. |
| 7,721,911 | B2 | 5/2010 | Chou |
| D625,139 | S | 10/2010 | Petlak |
| 7,832,586 | B2 | 11/2010 | Vovan |
| 7,866,502 | B2 | 1/2011 | Maxwell |
| D635,855 | S | 4/2011 | Smith et al. |
| D637,079 | S | 5/2011 | Brown et al. |
| 7,942,260 | B1 | 5/2011 | Rodriguez |
| D643,284 | S | 8/2011 | Zomorodi |
| D643,285 | S | 8/2011 | Zomorodi |
| D643,286 | S | 8/2011 | Zomorodi |
| 8,006,854 | B2 | 8/2011 | Waugh |
| D648,629 | S | 11/2011 | Zomorodi |
| 8,109,404 | B2 | 2/2012 | Chmela |
| 8,141,727 | B2 | 3/2012 | Gruenwald et al. |
| 8,317,024 | B1 | 11/2012 | Persi |
| 8,381,935 | B1 | 2/2013 | Buck |
| 8,448,801 | B2 | 5/2013 | Rusnak et al. |
| 8,574,647 | B1 * | 11/2013 | Gunderson ..... 426/115 |
| 8,590,730 | B2 | 11/2013 | Buck |
| 8,596,491 | B2 | 12/2013 | Buck |
| 8,695,845 | B2 | 4/2014 | Buck |
| 8,701,914 | B1 | 4/2014 | Buck |
| 8,708,181 | B2 | 4/2014 | Buck |
| 8,714,393 | B2 | 5/2014 | Buck |
| 8,783,506 | B2 | 7/2014 | Lee |
| 8,800,801 | B2 | 8/2014 | Freeman |
| 2001/0035417 | A1 | 11/2001 | Kantor |
| 2002/0037378 | A1 | 3/2002 | Littlejohn et al. |
| 2002/0125262 | A1 | 9/2002 | Canfield |
| 2002/0148833 | A1 | 10/2002 | Simon |
| 2003/0024930 | A1 | 2/2003 | Smith et al. |
| 2003/0089714 | A1 | 5/2003 | Dart et al. |
| 2003/0102312 | A1 | 6/2003 | Horner |
| 2003/0111468 | A1 | 6/2003 | Kao |
| 2003/0178433 | A1 | 9/2003 | Adams |
| 2004/0035867 | A1 | 2/2004 | Schultz et al. |
| 2004/0050724 | A1 | 3/2004 | Grul et al. |
| 2004/0050847 | A1 | 3/2004 | Yoon |
| 2004/0060934 | A1 | 4/2004 | Haynes et al. |
| 2004/0084452 | A1 | 5/2004 | Hsieh |
| 2004/0089662 | A1 | 5/2004 | Smith et al. |
| 2004/0149755 | A1 | 8/2004 | Olivar |
| 2004/0182862 | A1 | 9/2004 | Scott |
| 2005/0035011 | A1 | 2/2005 | McRobbie |
| 2005/0051549 | A1 | 3/2005 | Nelson |
| 2005/0082305 | A1 | 4/2005 | Dais |
| 2005/0103794 | A1 | 5/2005 | Liu |
| 2005/0115845 | A1 | 6/2005 | Cho |
| 2005/0178677 | A1 | 8/2005 | Morrow |
| 2005/0178688 | A1 | 8/2005 | Hasson |
| 2005/0199639 | A1 | 9/2005 | Tucker et al. |
| 2005/0205437 | A1 | 9/2005 | Huffman et al. |
| 2005/0269328 | A1 | 12/2005 | Crider et al. |
| 2006/0000842 | A1 | 1/2006 | Maxwell |
| 2006/0060589 | A1 | 3/2006 | Lee |
| 2006/0091143 | A1 | 5/2006 | Chantalat |
| 2006/0096983 | A1 | 5/2006 | Patterson |
| 2006/0124648 | A1 | 6/2006 | Croft et al. |
| 2006/0151414 | A1 | 7/2006 | Mullen |
| 2006/0261066 | A1 * | 11/2006 | Boozer et al. ..... 220/254.7 |
| 2007/0029322 | A1 | 2/2007 | Durdon et al. |

(56) References Cited

U.S. PATENT DOCUMENTS

| | | | | |
|---|---|---|---|---|
| 2007/0068949 | A1 | 3/2007 | Crossley | |
| 2007/0181581 | A1 | 8/2007 | Ross | |
| 2007/0241105 | A1 | 10/2007 | Nielsen | |
| 2007/0278122 | A1* | 12/2007 | McCumber et al. | 206/514 |
| 2008/0023503 | A1 | 1/2008 | Freeman | |
| 2008/0099481 | A1 | 5/2008 | D'Amato | |
| 2008/0230541 | A1 | 9/2008 | Bayss et al. | |
| 2008/0302802 | A1 | 12/2008 | Ramsden | |
| 2009/0065377 | A1 | 3/2009 | Olomi et al. | |
| 2009/0206089 | A1 | 8/2009 | Mueller | |
| 2009/0236305 | A1 | 9/2009 | DeMarco et al. | |
| 2009/0250479 | A1 | 10/2009 | Kaufman et al. | |
| 2009/0272390 | A1 | 11/2009 | Blondeel | |
| 2009/0283526 | A1 | 11/2009 | Pierce et al. | |
| 2010/0038273 | A1 | 2/2010 | Johnson | |
| 2010/0108703 | A1 | 5/2010 | French | |
| 2010/0187247 | A1 | 7/2010 | Ziegler | |
| 2010/0320213 | A1 | 12/2010 | Kelly et al. | |
| 2011/0114643 | A1 | 5/2011 | Bogdziewicz | |
| 2011/0168719 | A1 | 7/2011 | Lotterhos | |
| 2011/0198351 | A1 | 8/2011 | Doamato | |
| 2011/0198355 | A1 | 8/2011 | Mullen | |
| 2011/0210126 | A1 | 9/2011 | Vovan | |
| 2011/0248033 | A1 | 10/2011 | Mehrvijeh | |
| 2011/0266295 | A1 | 11/2011 | Yacktman | |
| 2011/0272656 | A1 | 11/2011 | Attwood | |
| 2011/0284537 | A1 | 11/2011 | Cerasani | |
| 2011/0303678 | A1 | 12/2011 | Zomorodi | |
| 2011/0309093 | A1 | 12/2011 | Buck | |
| 2012/0138608 | A1 | 6/2012 | Rusnak et al. | |
| 2012/0165170 | A1 | 6/2012 | Wischusen, III | |
| 2012/0187126 | A1 | 7/2012 | Shemesh | |
| 2012/0248116 | A1 | 10/2012 | Smyers et al. | |
| 2012/0273500 | A1 | 11/2012 | Yao | |
| 2013/0068772 | A1 | 3/2013 | Durdon | |
| 2013/0068773 | A1 | 3/2013 | Buck | |
| 2013/0068774 | A1 | 3/2013 | Buck | |
| 2013/0119065 | A1 | 5/2013 | Buck | |
| 2013/0228486 | A1 | 9/2013 | BUCK | |
| 2014/0175103 | A1* | 6/2014 | Oh | 220/600 |
| 2014/0203025 | A1 | 7/2014 | Riggan et al. | |

FOREIGN PATENT DOCUMENTS

| | | | |
|---|---|---|---|
| EP | 0162024 | A2 | 11/1985 |
| EP | 2205309 | | 12/1988 |
| EP | 0447693 | A1 | 9/1991 |
| EP | 1397986 | | 3/2004 |
| FR | 2649080 | | 6/1989 |
| FR | 2704209 | | 10/1994 |
| GB | 1060389 | | 3/1967 |
| GB | 2322289 | | 8/1998 |
| GB | 2375531 | | 11/2002 |
| JP | 04102557 | | 4/1992 |
| RU | 2118281 | | 8/1998 |
| WO | 2006029441 | | 3/2006 |
| WO | 2012033472 | | 3/2012 |

OTHER PUBLICATIONS

Internationa Search Report and Written Opinion issued in PCT/US2013/029188 on Jul. 11, 2013.

Internationa Search Report and Written Opinion issued in PCT/US2013/070630 on Mar. 13, 2014.

Internationa Search Report and Written Opinion issued in PCT/US2013/070632 on Mar. 13, 2014.

International Preliminary Report on Patentability issued in PCT/US2012/054032 on Mar. 20, 2014.

Prodekspo 2012: TM "Zelenaya Soya" razdelnaya upakovka dlya napitkov, Feb. 16, 2012, retrieved online on Jun. 11, 2013, retrieved from the internet http://news.unipak.ru38718comments.

* cited by examiner

FIG. 16
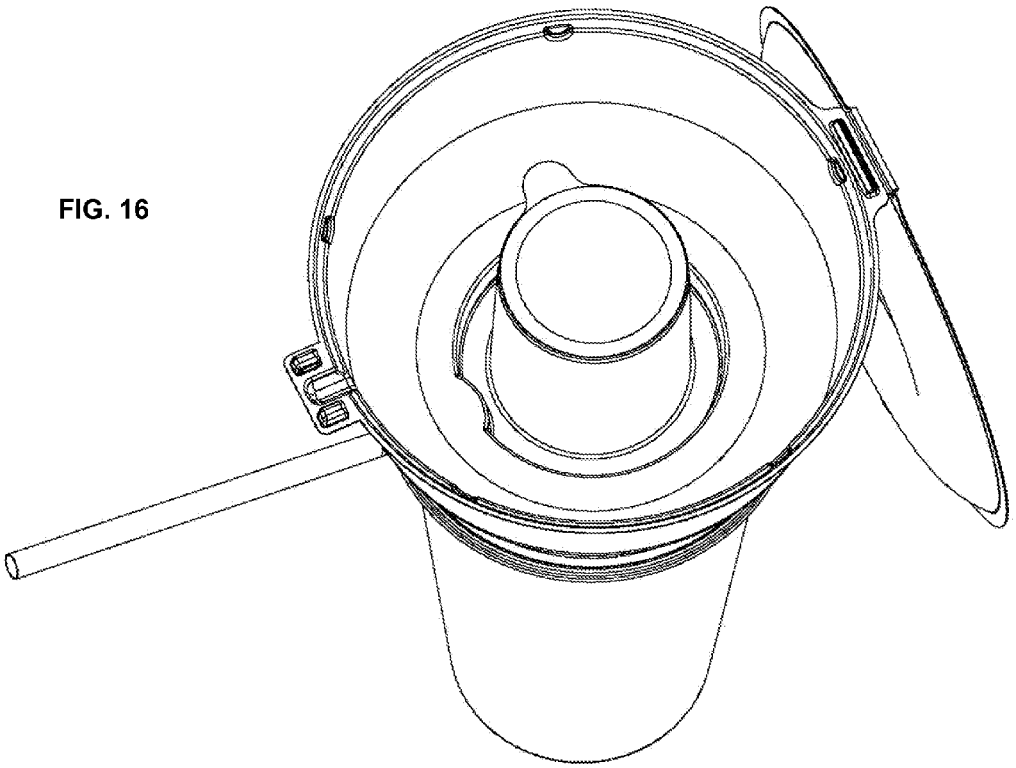
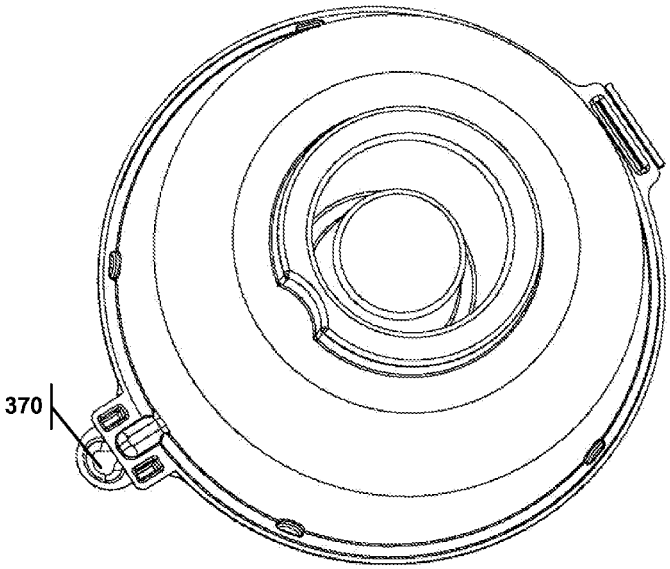
FIG. 17

CONTAINER LID SYSTEM WITH A LID PORTION AND FOOD CONTAINER PORTION

1.0 TECHNICAL FIELD

The present invention relates to lids for disposable containers, and particularly to a new and novel lid system with a food container.

2.0 RELATED APPLICATIONS

This application claims priority as the non-provisional of U.S. Patent Application Ser. No. 62/005,862 filed on May 30, 2014, the contents of which are fully incorporated herein by reference.

This application is also related to U.S. Pat. No. 8,596,491 entitled "CUP LID WITH INTEGRATED CONTAINER" issued on Dec. 3, 2013; U.S. Pat. No. 8,695,845 entitled "TOP MOUNTING CAN CONTAINER" issued on Apr. 15, 2014; U.S. Pat. No. 8,381,935 entitled "CUP LID WITH INTEGRATED CONTAINER" issued on Feb. 26, 2013; U.S. Pat. No. 8,714,393 entitled "CUP LID WITH INTEGRATED CONTAINER" issued on May 6, 2014; U.S. Pat. No. 8,590,730 entitled "TOP MOUNTING CAN CONTAINER" issued on Nov. 26, 2013; U.S. Pat. No. 8,708,181 entitled "LID WITH INTEGRATED CONTAINER" issued on Apr. 29, 2014; U.S. Pat. No. 8,701,914 entitled "TWO-PART RECYCLABLE CUP" issued on Apr. 22, 2014; U.S. patent application Ser. No. 13/412,602 entitled "TOP MOUNTING BOTTLE CONTAINER" filed on Mar. 5, 2012; U.S. patent application Ser. No. 13/680,011 entitled "CUP LID WITH INTEGRATED CONTAINER" filed on Nov. 17, 2012; U.S. patent application Ser. No. 13/680,049 entitled "CUP LID WITH INTEGRATED CONTAINER" filed on Nov. 17, 2012; U.S. patent application Ser. No. 13/733,153 entitled "CUP LID WITH INTEGRATED CONTAINER" filed on Jan. 3, 2013; U.S. patent application Ser. No. 14/263,993 entitled "LID WITH INTEGRATED CONTAINER" filed on Apr. 28, 2014; U.S. patent application Ser. No. 14/269,016 entitled "A CONTAINER LID WITH ONE OR MORE CAVITIES" filed on May 2, 2014; and U.S. patent application Ser. No. 14/274,576 entitled "A CONTAINER LID WITH A FOOD COMPARTMENT AND A SIP-HOLE" filed on May 9, 2014, all of which are by the same inventor of the present application. Each of these applications is incorporated herein by reference.

3.0 BACKGROUND

The increased popularity of fast food establishments, coupled with the popularity for consumption of food on-the-go has led to the need for more convenient food packaging.

Billions of disposable beverage containers are used every year. Often those containers are part of a larger meal, and current technology dictates placing a lid on the beverage container, and packing the food in a separate and detached container. This may be satisfactory for a consumer seated at a table. However, when the consumer must eat on-the-go, use of the current technology is problematic. Consider, for example, a consumer that is drinking the beverage and would like to access a breakfast sandwich. The consumer must set aside a beverage, and then use one hand to hold the bag and the other hand to access the sandwich, then set aside the bag and use both hands to open the sandwich packaging. As shown in this example, current technology does not allow for convenient on-the-go eating.

To address some of these problems, yogurt manufactures have placed a small food container on the lid of a yogurt cup. The food container (often holding nuts or granola) must be removed from the yogurt cup and then flipped over and opened, then the contents are poured into the yogurt cup. It is therefore not possible to simultaneously access the contents of the yogurt cup and the contents of the food container; rather the food container must be completely disengaged from the cup to access either contents of the yogurt cup or the contents of the food container. The food container that attaches to the yogurt cup in an upside-down position has a limited food-volume capacity because its walls taper as they proceed upward toward the bottom of the upside down container. Without this tapering, the yogurt cup/food container complex would become top-heavy and cumbersome.

What is therefore needed is a lid that overcomes these shortcomings, and fosters convenient on-the-go eating.

4.0 SUMMARY

The present invention provides an elegant solution to the needs described above and provides numerous additional benefits and advantages as will be apparent to persons of skill in the art. One aspect provides a container lid system that has two parts: a lid portion and food container portion. The lid portion has a coupling trough for attachment to the rim a beverage container and to form a liquid-tight seal with the beverage container. The lid portion also has an outer lid portion riser wall connected to the coupling trough, the outer lid portion riser wall extends away from the coupling trough and defines a first lid portion surface that is generally orthogonal to the outer lid portion riser wall. The lid portion also has an inner lid portion riser wall connected to the first lid portion surface that extends generally orthogonally away from the first lid potion surface and defines a second lid portion surface that is generally orthogonal to the inner lid portion riser wall. The food container portion has a first food container surface connected to an inner food container riser wall. The inner food container riser wall extends generally orthogonally away from the first food container surface and defines a second food container surface that is generally orthogonal to the inner food container riser wall. The food container portion also has an outer food container riser wall connected to the second food container surface that extends generally orthogonally away from the second food container surface and defines a food container cavity. The first food container also has a condiment receiver structure. The cross section of the lid portion and the cross section of the food container portion are substantially complementary to each other, such that the food container portion may snuggly mate with the lid portion.

In another aspect, the food container portion may include a hinge connected to a top cover that covers the food container cavity. The food container portion and the cover may have latch structures that mate with each other when the top cover is closed, and the cover may have a grip handle. The outer food container riser wall may have a cover coupling structure and a top cover may have a cover complementary coupling structure that detachably mates with the cover coupling structure. Also, the food container portion may have an alignment structure that restricts the position of the food container portion relative to the lid portion when the food container portion mates to the lid portion. The food container may also have a leg post.

In another aspect, the lid portion may have a sip/gulp hole or a straw hole. The lid portion may also have at least one secure fastening indent. Also, the lid portion may have an alignment structure that restricts the position of the food container portion relative to the lid portion when the food container portion mates to the lid portion.

In yet another aspect, the condiment receiver structure includes an outer condiment receiver riser wall that extends generally orthogonally away from the first food container surface and defines an upper condiment receiver surface that is generally orthogonal to the outer condiment receiver wall. The upper condiment receiver surface may have a hole to receive a condiment package. The condiment receiver structure may also have an inner condiment receiver riser wall connected to the upper condiment receiver surface that extends generally orthogonally away from the upper condiment receiver surface and connects to a condiment receiver bottom. The inner condiment receiver riser wall and the condiment receiver bottom may define a condiment cavity that can receive a condiment package/container or an unpackaged condiment.

The foregoing summary is illustrative only and is not meant to be exhaustive. Other aspects, objects, and advantages of this invention will be apparent to those of skill in the art upon reviewing the drawings, the disclosure, and the appended claims.

5.0 BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. It will be understood that certain components and details may not appear in the figures to assist in more clearly describing the invention.

FIG. 16 is an isometric top view of the food container portion with the top cover hinged open of the novel lid system of FIG. 14.

FIG. 17 is an isometric bottom view of the food container portion and top cover of the novel lid system of FIG. 14.

6.0 DETAILED DESCRIPTION OF EXAMPLE EMBODIMENTS

Following is a non-limiting written description of example embodiments illustrating various aspects of the invention. These examples are provided to enable a person of ordinary skill in the art to practice the full scope of the invention without having to engage in an undue amount of experimentation. As will be apparent to persons skilled in the art, further modifications and adaptations can be made without departing from the spirit and scope of the invention, which is limited only by the claims.

In the following description, numerous specific details are set forth in order to provide a thorough understanding of the present invention. Particular example embodiments of the present invention may be implemented without some or all of these features or specific details. In other instances, components well known to persons of skill in the art have not been described in detail in order not to obscure unnecessarily the present invention.

Figure 1:
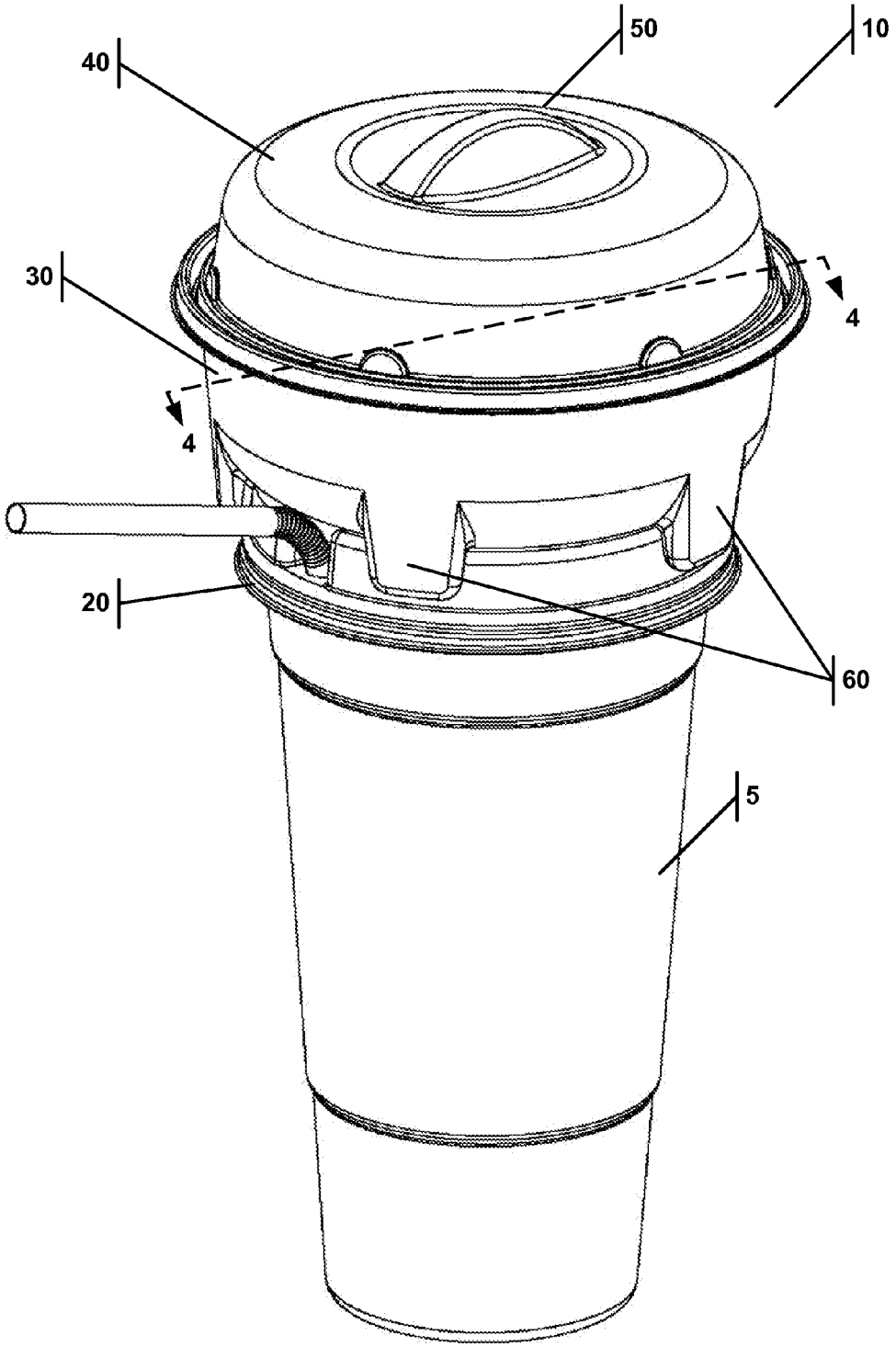
FIG. 1 is an isometric view of a first embodiment of a novel container lid system with a lid portion, food container portion and detachable top cover.

Referring to FIG. 1, novel container lid system 10 with a lid portion 20, food container portion 30 and detachable top cover 40. The lid system 10 is connected to a beverage container 5. The top cover 40 is shown with a grip handle 50 and is coupled to the food container portion 30. This coupling is described in more detail in reference to FIG. 4 below. The food container portion 30 may also have leg posts 60 that help stabilize the food container portion 30 when it is mated with the lid portion 20. These leg posts 60 also help stabilize the food container portion 30 when it is separated from the lid portion 20 and placed on a horizontal surface, such as a table.

Figure 2:
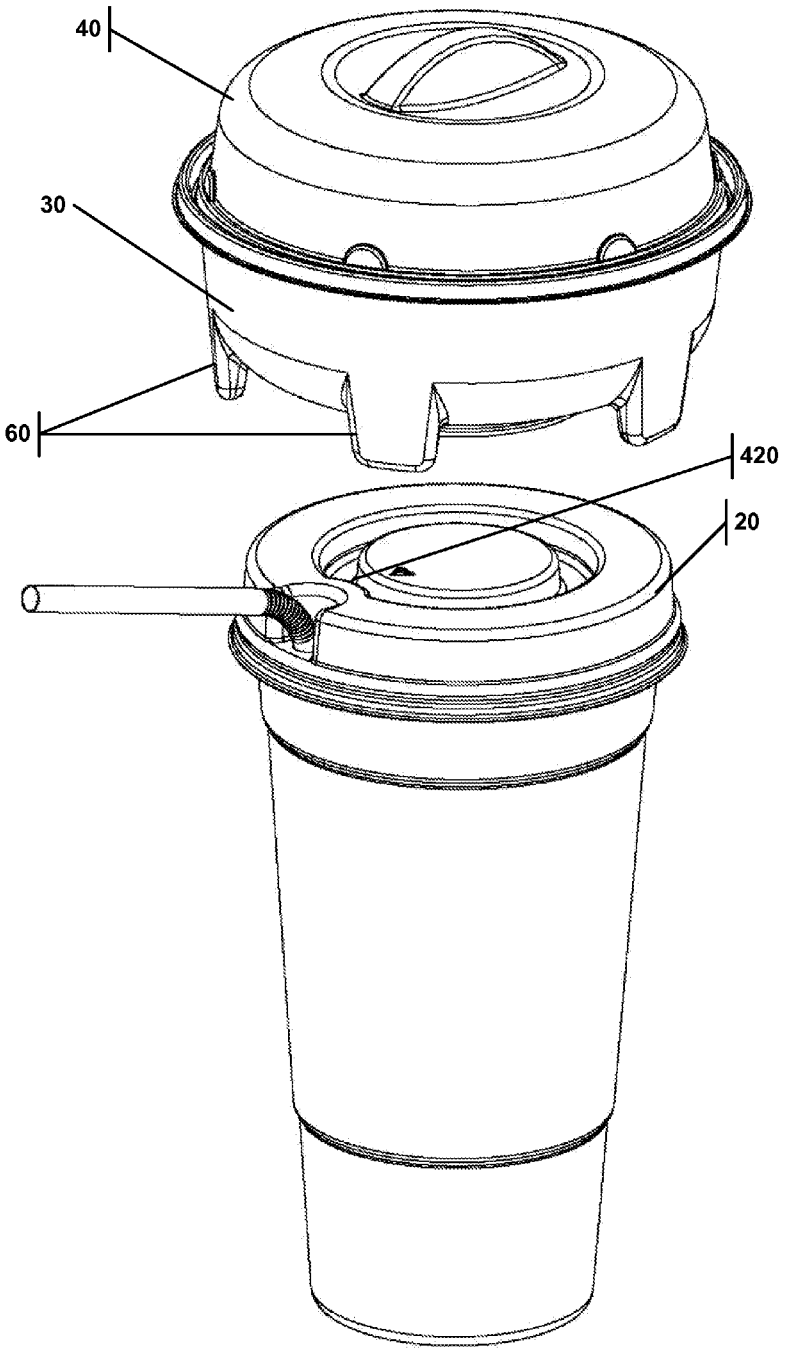
FIG. 2 is an isometric view of the novel lid system of FIG. 1 with the food container portion detached from the lid portion.

FIG. 2 shows the food container portion 30 detached from the lid portion 20. It is more apparent in this view that the leg posts 60 will stabilize the food container portion 30 when placed on a table. Also shown in FIG. 2 is an alignment structure 420 that orients the food container portion 30 with the lid portion 20.

Figure 3:
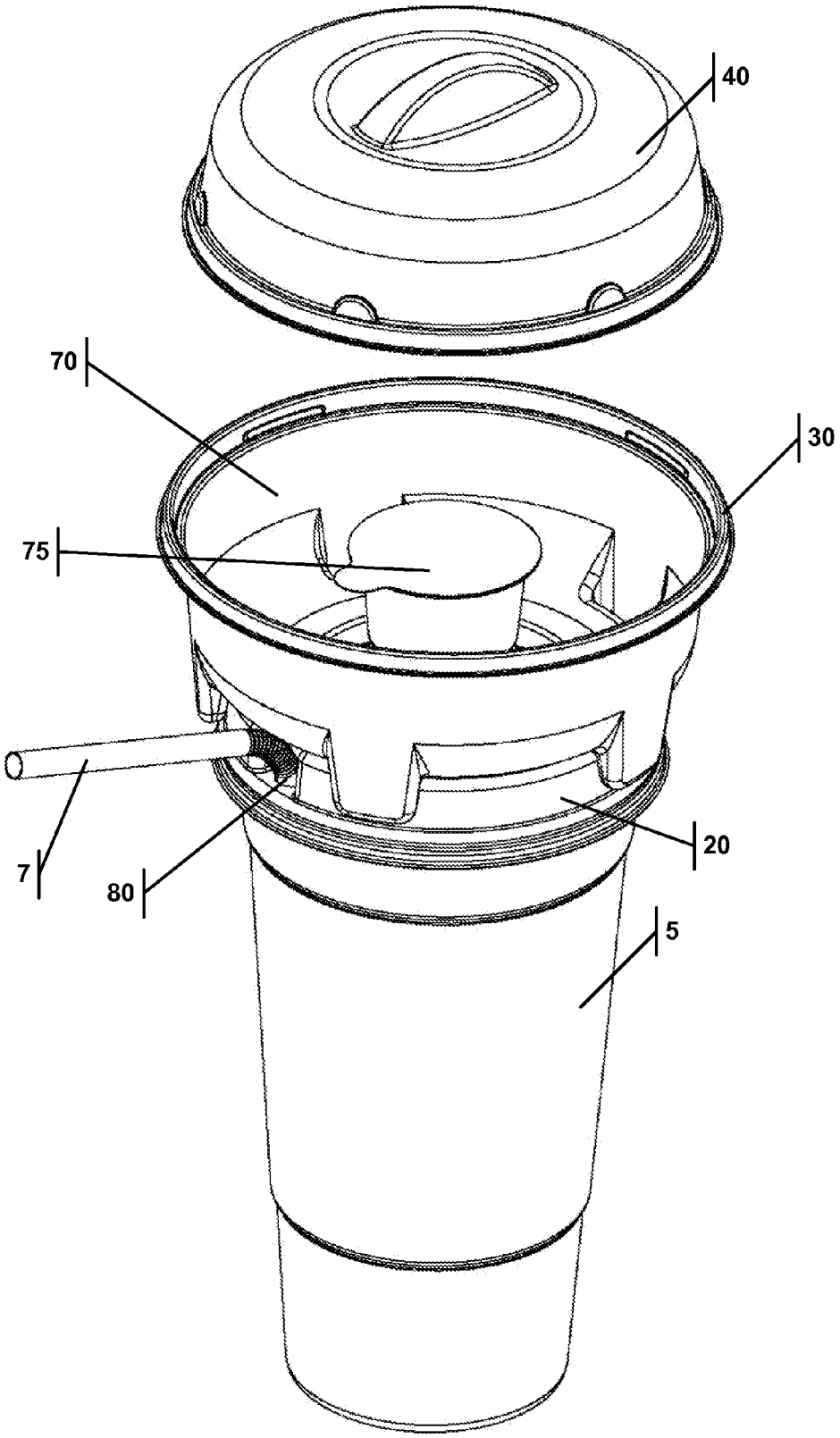
FIG. 3 is an isometric view of the novel lid system of FIG. 1 with the top cover detached from the food container portion.

In FIG. 3, the top cover 40 is removed to show the food container cavity 70, into which food may be placed. Within the food container cavity 70 is a condiment receiver structure (shown in more detail in FIG. 4) into which a condiment (or condiment package) may be directly placed, or a condiment package may be mounted. FIG. 3 shows a condiment package 75 mounted onto the condiment receiver structure (not shown). With the condiment package 75 mounted, finger foods such as, but not limited to, chicken nuggets, French fries, and fish sticks may be placed around the condiment package 75. Removing the cover from the condiment package 75 exposes the condiment and the user may then grab a food item, dip it in the condiment and eat it. This can all be done with one hand, while the other hand is holding the beverage container 5. Further, the user can sip beverage through the straw 7 that travels through a straw hold 80 in the lid portion 20 thus accessing the beverage contained by the beverage container 5. If the user is not on-the-go, the user can detach the food container portion 30 from the lid portion 20 and place it on the table.

Figure 4A:
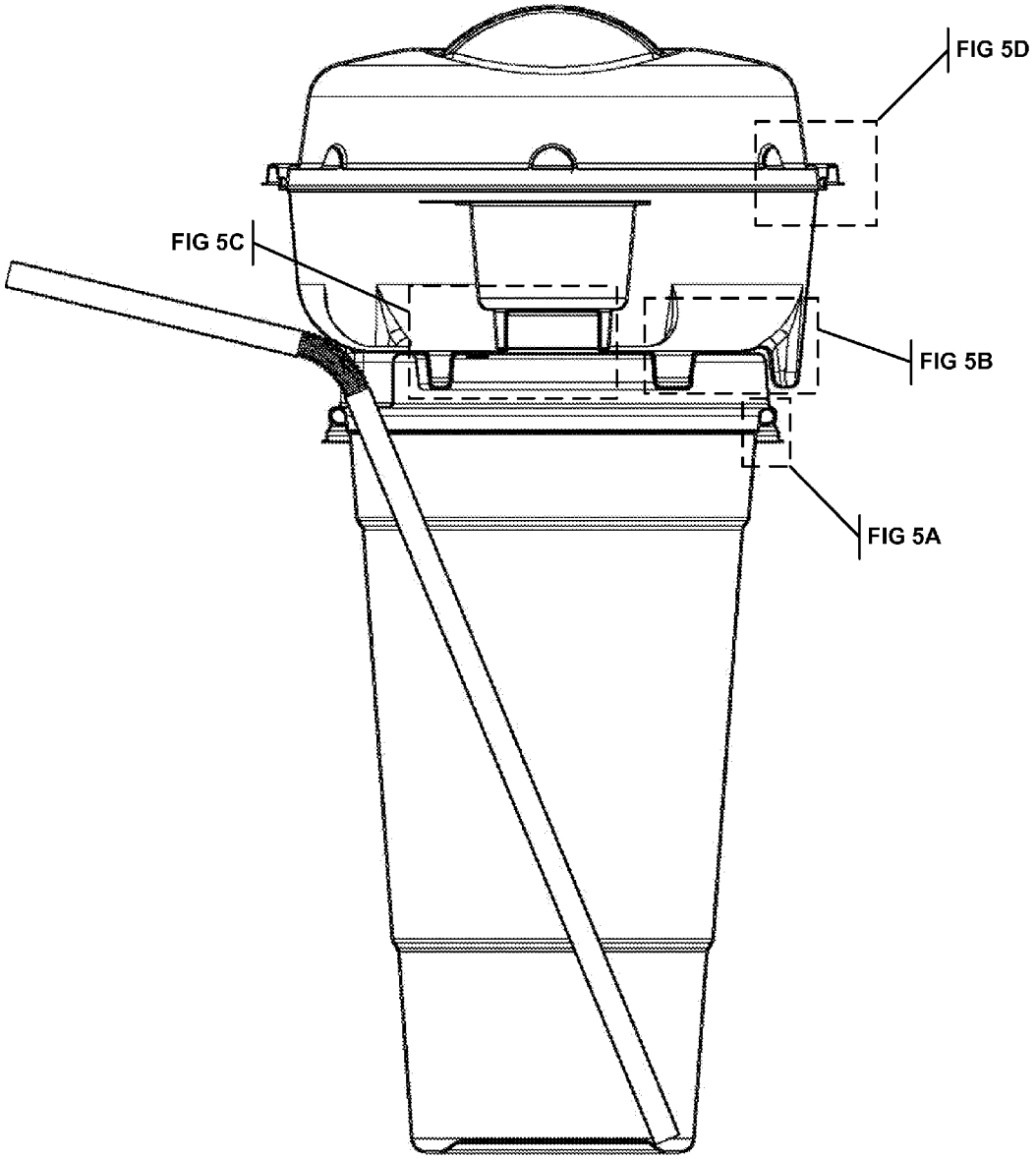
FIG. 4A is a cross section of the novel lid system of FIG. 1 taken along line 4-4 of FIG. 1.
Figure 4B:
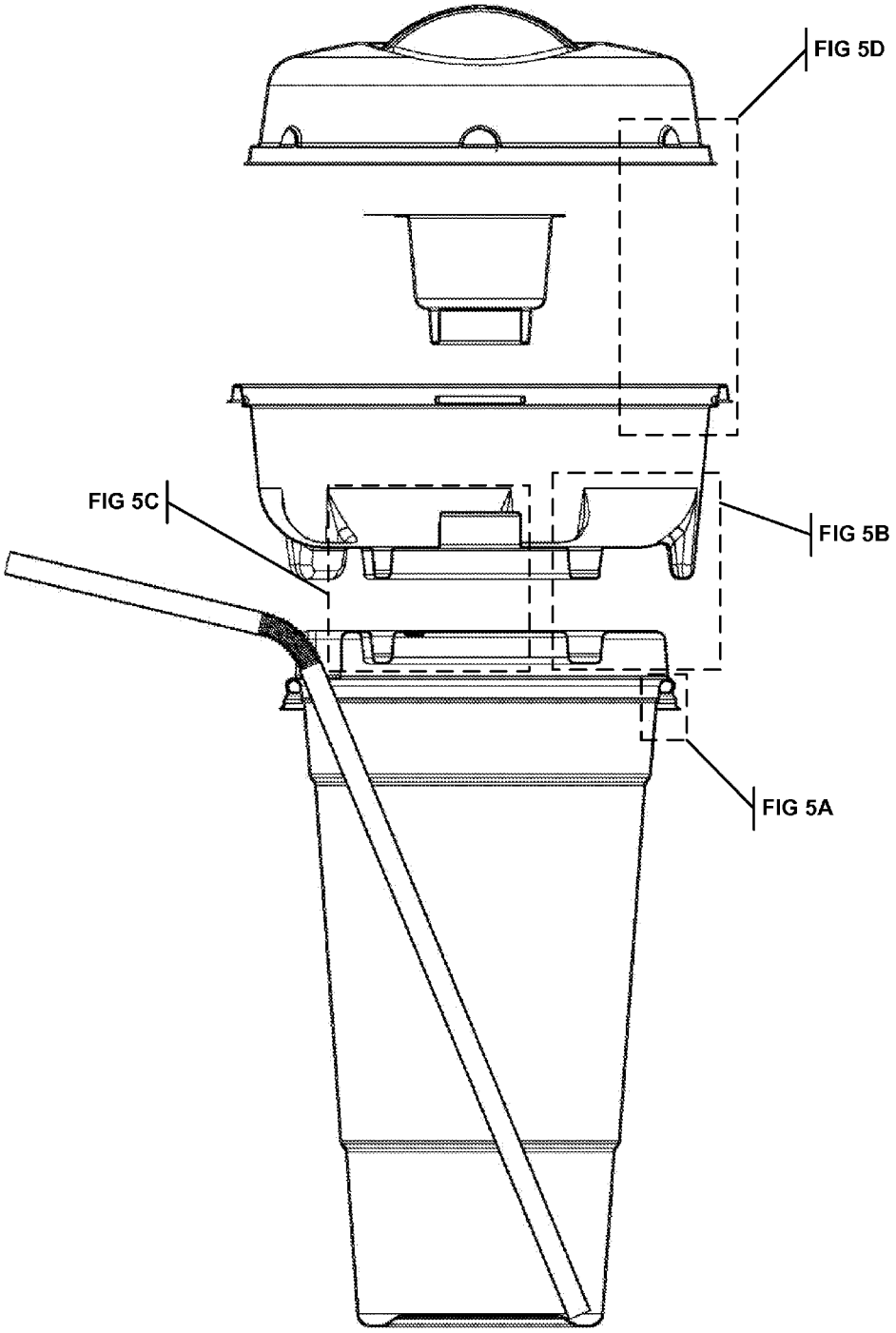
FIG. 4B is an exploded cross section of the novel lid system of FIG. 1.

FIGS. 4A and 4B are cross sectional views taken along line 4-4 of FIG. 1, and illustrates many of the features of the container lid system 10. Shown in more enlargement at FIGS. 5A, 5B, 5C and 5D are various portions of this cross section.

Figure 5A:
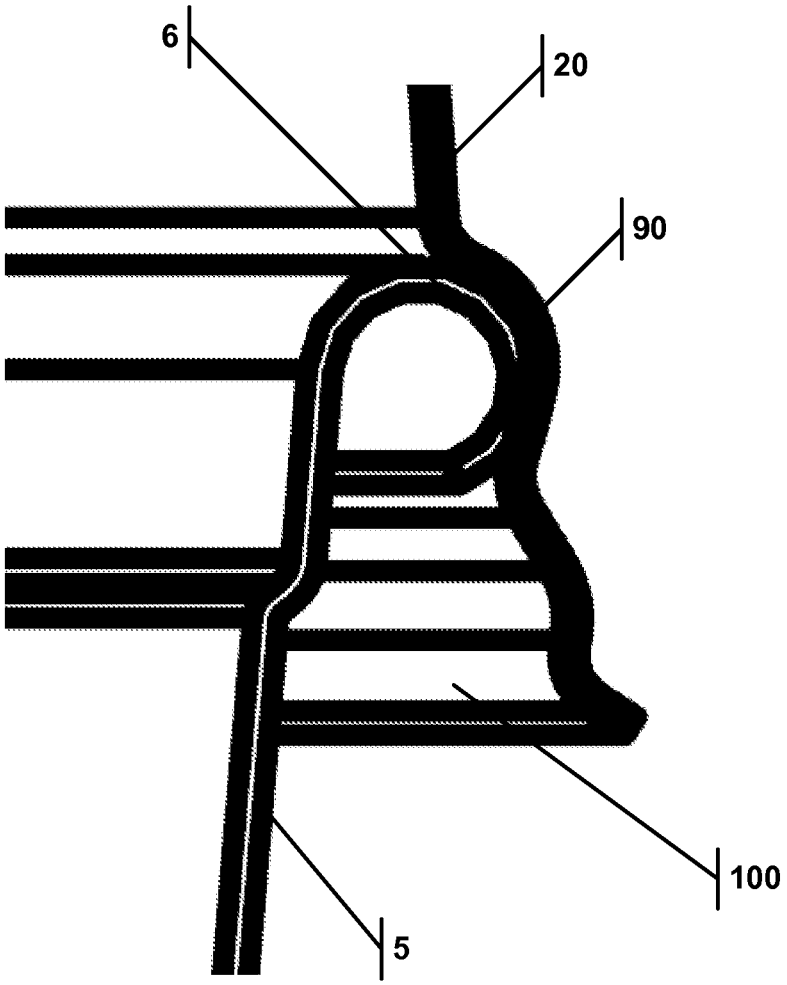
FIG. 5A is a cross section of the novel lid system of FIG. 1 illustrating the coupling of the lid portion to the beverage container.

FIG. 5A illustrates in more detail the coupling of the lid portion 20 to the beverage container 5. The lid portion 20 contains a coupling trough 90 that snaps over the rim 6 of the beverage container 5 and forms a liquid tight seal with the beverage container 5. Because the coupling trough 90 is constructed of a semi-compliant material as is the rim 6, the coupling trough 90 would slightly flex when the rim 6 is inserted and that flexing would cause the coupling tough 90 to exert compressive force on the rim 6 forming the liquid tight seal. The coupling tough 90 may be flared 100 so as to help guide rim 6 into proper position.

Figure 5B:
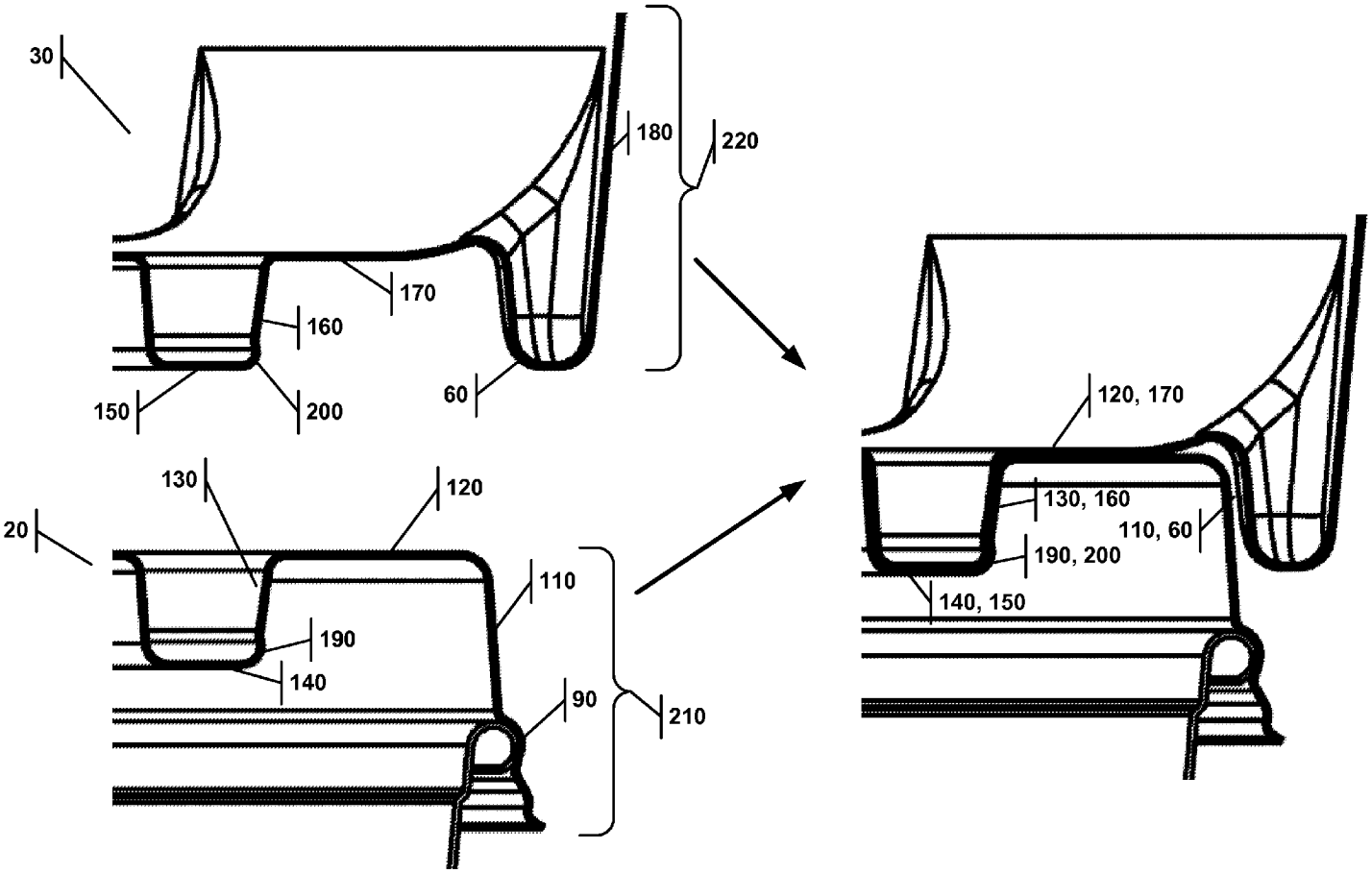
FIG. 5B is a cross section of the novel lid system of FIG. 1 showing the cross section of the lid portion as complementary to the cross section of the food container portion, such that the food container portion mates with the lid portion snugly.

Extending away from the coupling trough 90 is an outer lid portion riser wall 110, shown in FIG. 5B. The outer lid portion riser wall 110 defines a first lid portion surface 120 that is generally orthogonal to the outer lid portion riser wall 110. An inner lid portion riser wall 130 is connected to the first lid portion surface 120 and extending generally orthogonally away from the first lid potion surface 120. The inner lid portion riser wall 130 also defines a second lid portion surface 140 that is generally orthogonal to the inner lid portion riser wall 130.

Turning to the food container portion 30 of FIG. 5B, it includes a first food container surface 150 connected to an inner food container riser wall 160 that extends generally orthogonally away from the first food container surface 150. The inner food container riser wall 160 defines a second food container surface 170 that is generally orthogonal to the inner food container riser wall 160. An outer food container riser wall 180 is connected to the second food container surface 170 and extends generally orthogonally away from the second food container surface 170 and defines the food container cavity 70 (see FIG. 3). The food container portion 30 may also have leg posts 60 formed into the outer food container riser wall 180, but this is optional.

To assist in the snug mating of the lid portion 20 to the food container portion 30, the inner lid portion riser wall 130 may include an inner lid portion riser wall coupling structure 190. The inner food container riser wall 160 may also include an inner food container riser wall coupling structure 200 that is constructed to detachably mate with the inner lid portion riser wall coupling structure 190. Because the inner food container riser wall coupling structure 200 and the inner lid portion riser wall coupling structure 190 are constructed of a semi-compliant material, these structures would slightly flex when the lid portion 20 is mated with the food container portion 30 and that flexing would cause the inner lid portion riser wall coupling structure 190 to exert pressure on the inner food container riser wall coupling structure 200, thereby securing the union. (shown in the right side of FIG. 5B).

The lid portion cross section 210 (which may include the inner lid portion riser wall 130, the first lid portion surface 120 and the outer lid portion riser wall 110) is substantially complementary to food container cross section 220 (which may include the inner food container riser wall 160, the first food container surface 150, the second food container surface 170 and the leg posts 60). The complementary nature of these portions allows the food container portion 30 to snuggly mate with the lid portion 20 as shown in the right side of FIG. 5B.

Figure 5C:
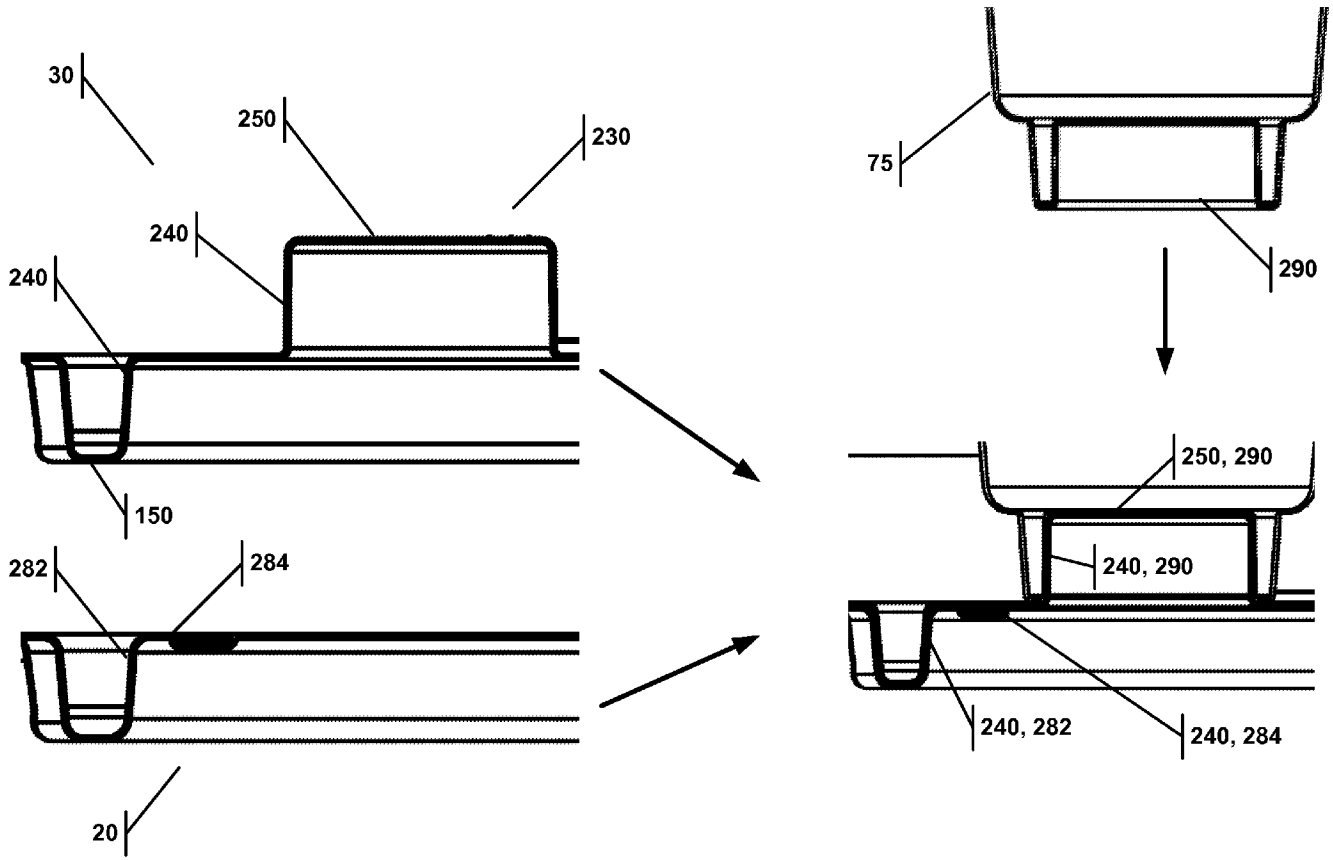
FIG. 5C is a cross section of the novel lid system of FIG. 1 illustrating the condiment receiver structure.

Turning to FIG. 5C, the condiment receiver structure 230 will be discussed. The condiment receiver structure 230 extends away from the first food container surface 150. Although shown extending upwardly away, the condiment receiver structure 230 may extend downwardly away from the first food container surface 150. The condiment receiver structure 230 may include an outer condiment receiver riser wall 240 (shown in FIG. 5C with an intermediate step) that extends generally orthogonally away from the first food container surface 150 and defines a condiment receiver surface 250 that is generally orthogonal to the outer condiment receiver wall 240. The condiment receiver surface 250 may have a hole adapted to receive a condiment package.

Figure 8:
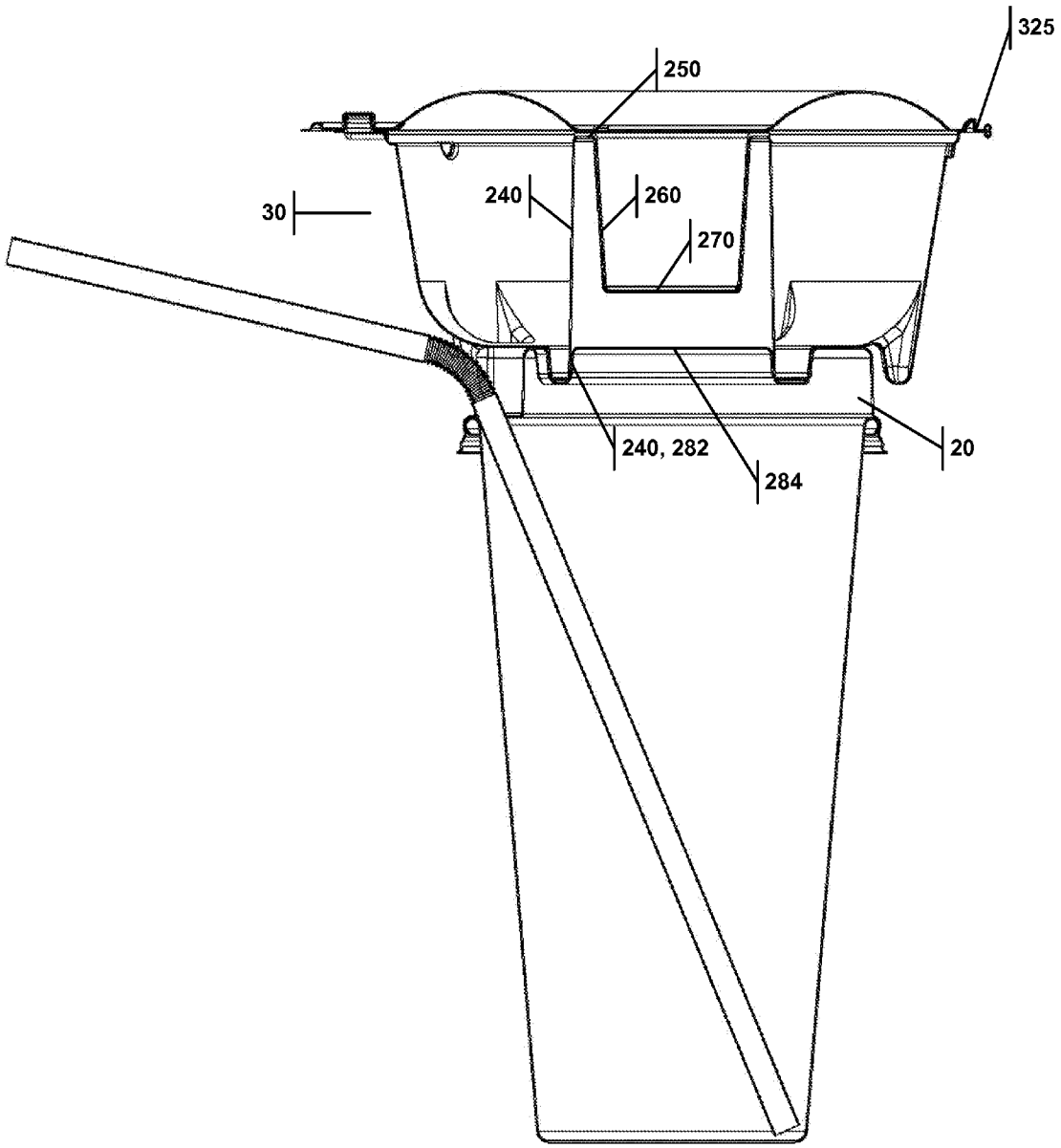
FIG. 8 is a cross section of the novel lid system of FIG. 6 taken along line 8-8 of FIG. 6.
Figure 9:
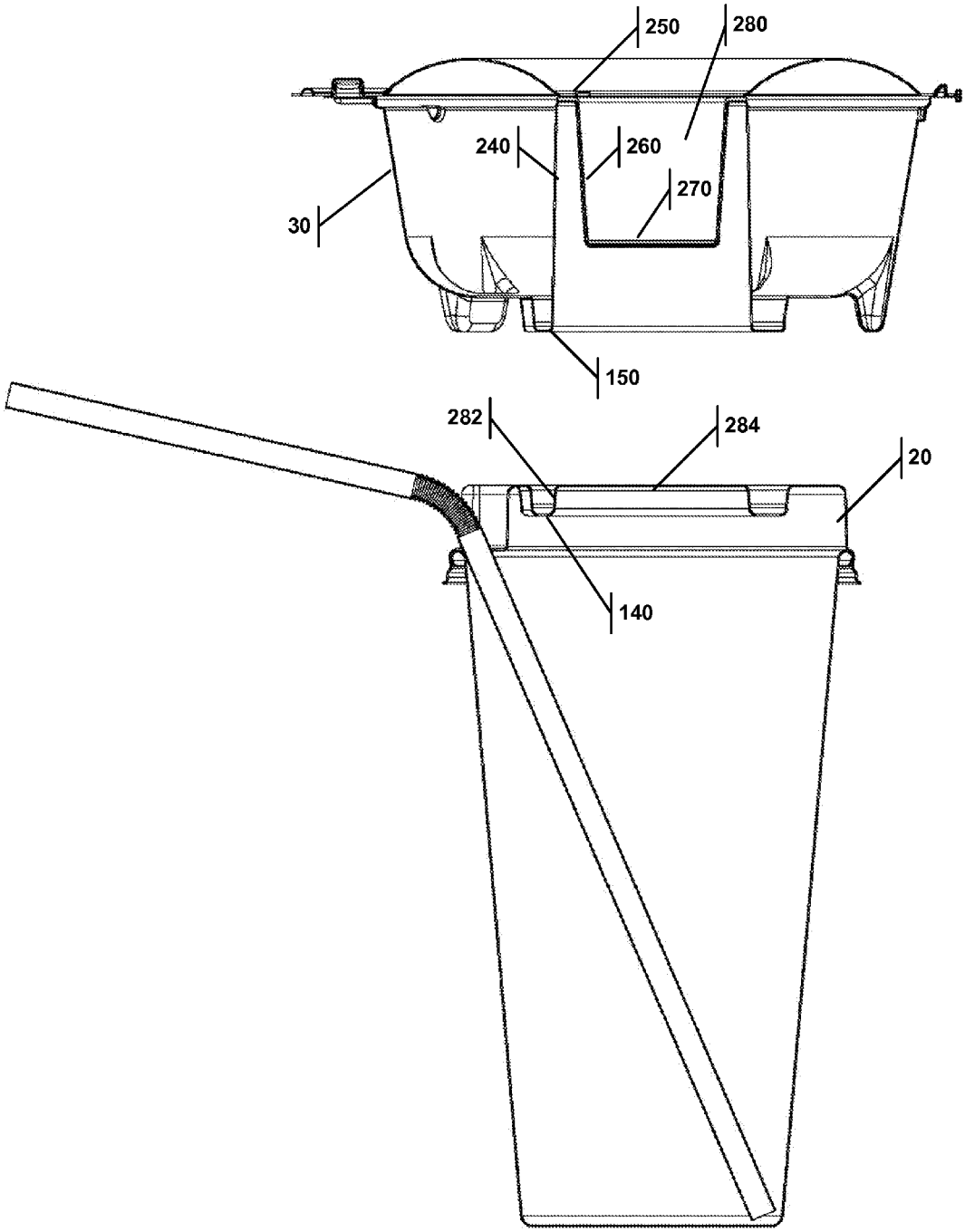
FIG. 9 is a cross section of the novel lid system of FIG. 6 with the food container portion detached from the lid portion.

Turning briefly to FIGS. 8 and 9, a different embodiment of the condiment receiver structure 230 is shown. There, the outer condiment receiver wall 240 extends further from the first food container surface 150 and does not have an intermediate step. The outer condiment receiver wall 240 connects to a condiment receiver surface 250, which then connects to an inner condiment receiver riser wall 260 that extends generally orthogonally away from the condiment receiver surface 250 and terminates at a condiment receiver bottom 270. The inner condiment receiver riser wall 260 and the condiment receiver bottom 270 create a condiment cavity 280 that can receiver receive a condiment package 75 or an unpackaged condiment.

The lid portion 20 in FIGS. 8 and 9 also illustrates a second inner lid portion riser wall 282 connected to a second lid portion surface 140 that extends generally orthogonally away from the second lid portion surface 140 and defines a third lid portion surface 284 that is generally orthogonal to the second inner lid portion riser wall 282. (see also FIG. 5C). The second inner lid portion riser wall 282 may butt up against the outer condiment receiver wall 240 and provide additional support and stability to the food container portion 30 when the food container portion 30 is mated to the lid portion 20.

Again returning to FIG. 5C, the condiment package 75 may include a complementary cupping structure 290 that mounts to the condiment receiver structure 230. This is shown on the bottom right side of FIG. 5C, where the lid portion 20 is mated with the food container portion 30, and the condiment package 75 is mounted on the condiment receiver structure 230.

Figure 5D:
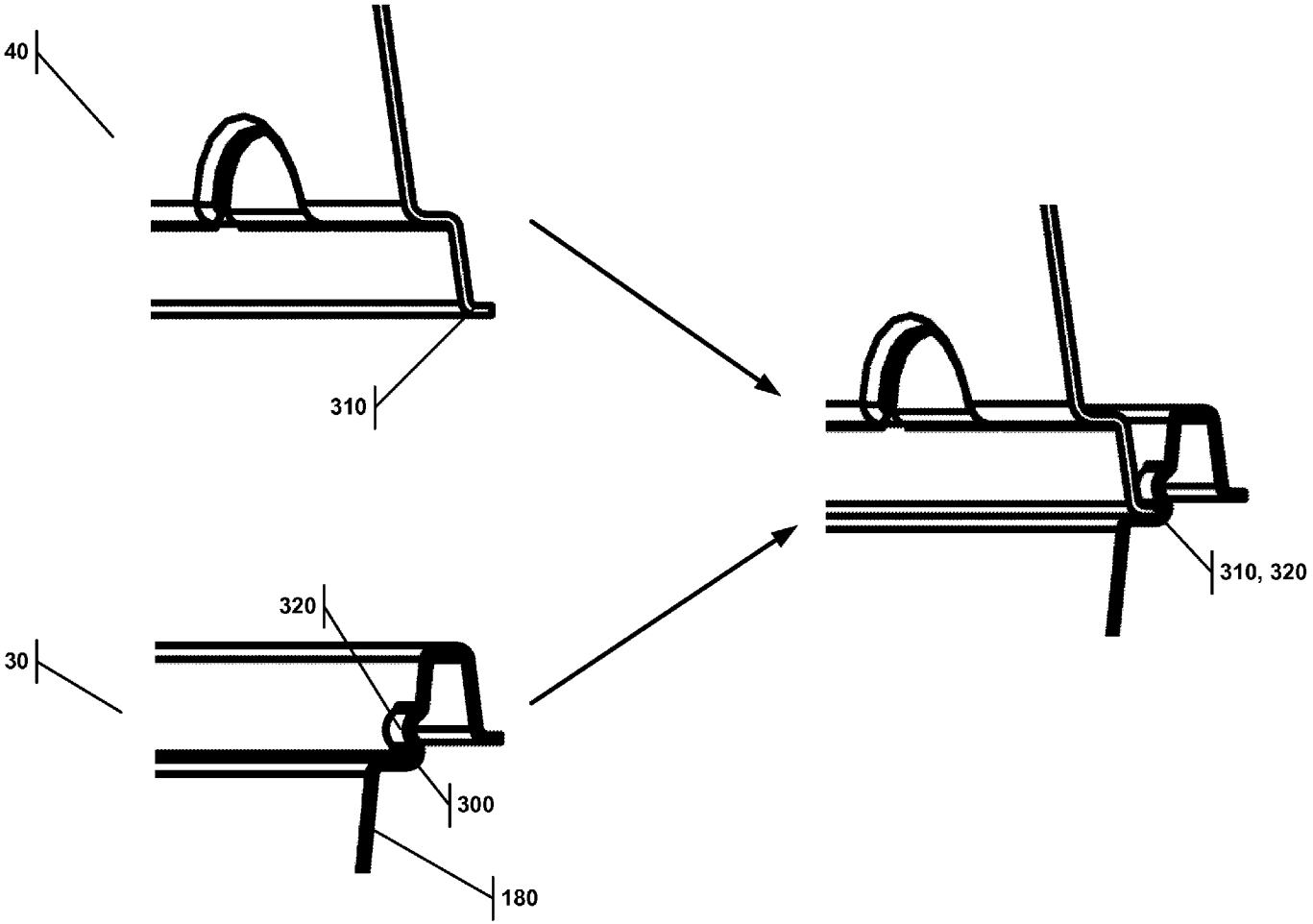
FIG. 5D is a cross section of the novel lid system of FIG. 1 illustrating the coupling of the top cover to the food container portion.
Figure 6:
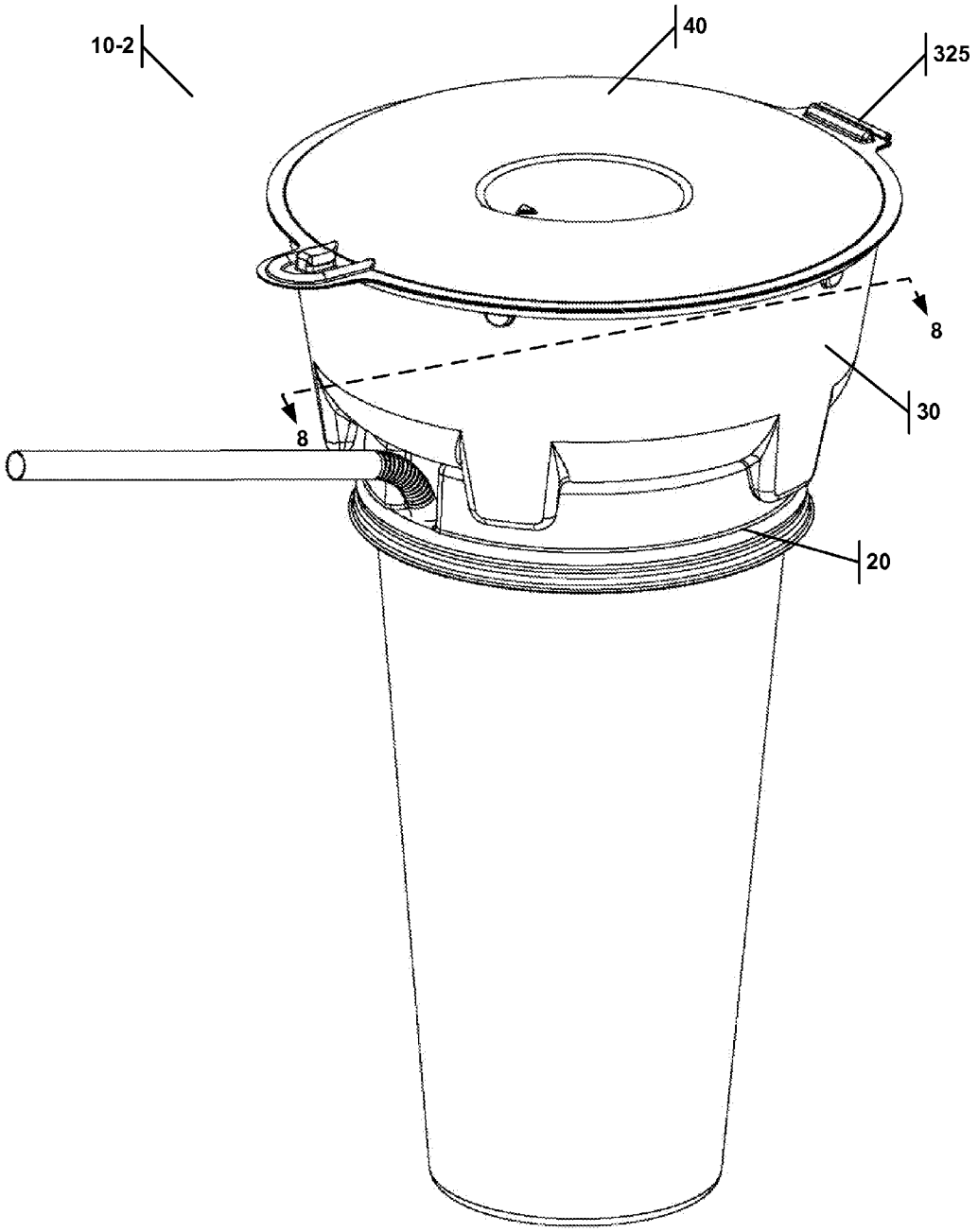
FIG. 6 is an isometric view of a second embodiment of a novel container lid system with a lid portion, food container portion and a hinged top cover.
Figure 7:
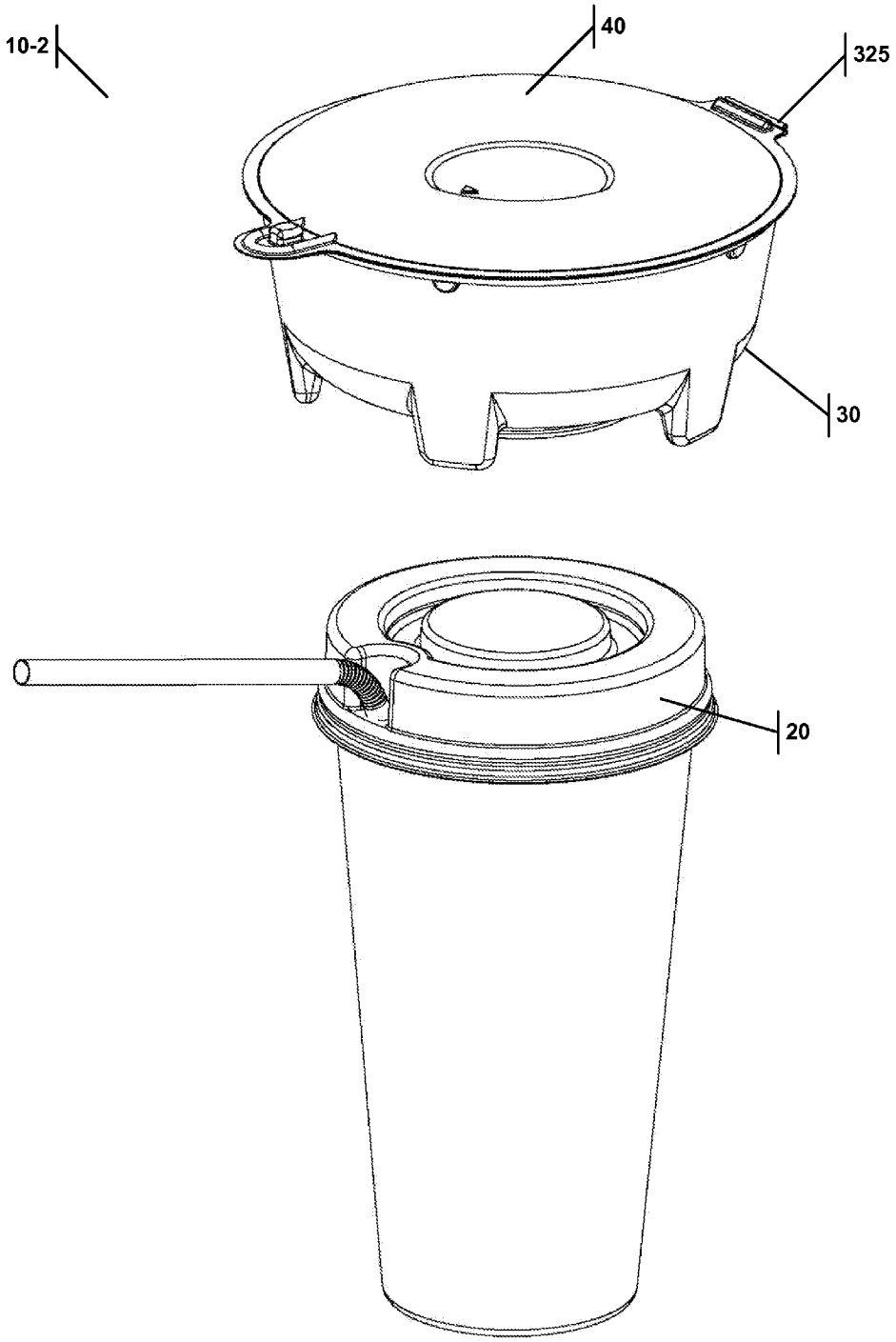
FIG. 7 is an isometric view of the novel lid system of FIG. 6 with the food container portion detached from the lid portion.

FIG. 5D is a cross section illustrating the coupling of the top cover 40 to the food container portion 30. The food container portion 30 may include a cover coupling structure 300 adjacent to the outer food container riser wall 180. The top cover 40 may include a cover complementary coupling structure 310 that is constructed to detachably mate with the cover coupling structure 300 (as shown in the right side of FIG. 5D). Because the top cover 40 and the food container portion 30 are constructed of a semi-compliant material, these structures would slightly flex when the top cover 40 is mated with the food container portion 30 and that flexing would cause the cover coupling structure 300 to exert pressure on the cover complementary coupling structure 310, thereby securing the union. (shown in the right side of FIG. 5D). This secure union may be further enhanced by having a slight inward indent 320 on the cover coupling structure 300, under which the cover complementary coupling structure 310 is disposed when the top cover 40 is mated with the food container portion 30. Although FIG. 5D shows the top cover 40 coupled to the interior wall portion of the coupling structure 300, the top cover 40 may alternatively couple to the exterior wall portion of the coupling structure 300.

Securing the top cover 40 to the food container portion 30 not only assists in securing the food in the food container cavity, but also inhibits the transfer of heat into and out of the food container cavity. This help keep the food at the optimal temperature until the user consumes it.

FIGS. 6 through 13B present a second embodiment of the present invention. Many of the structures already discussed are incorporated into this embodiment. A major difference with this second embodiment is that the top cover 40 is connected to the food container portion 30 by a hinge 325.

Figure 10:
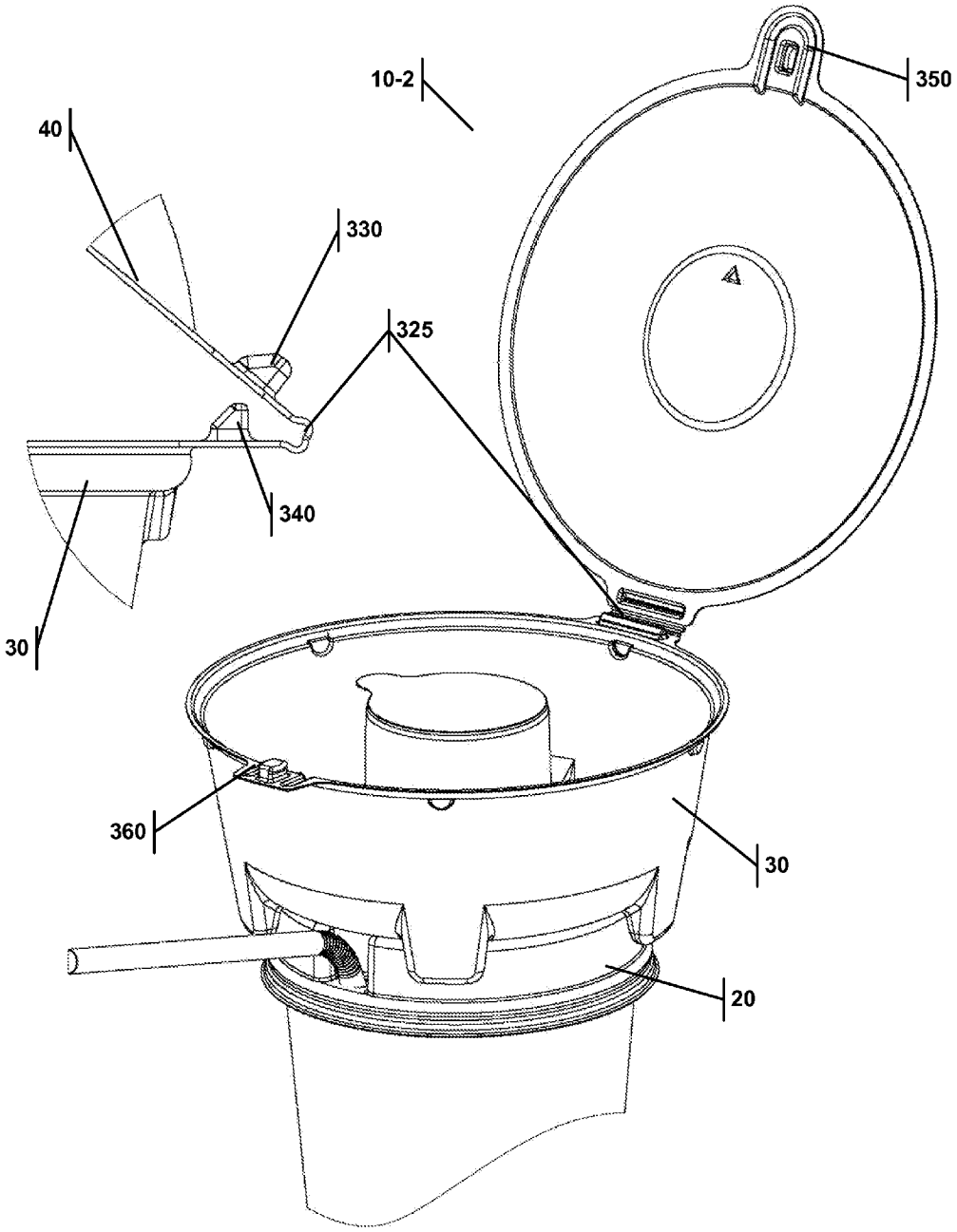
FIG. 10 is an isometric view of the novel lid system of FIG. 6 with the top cover hinged open.
Figure 11:
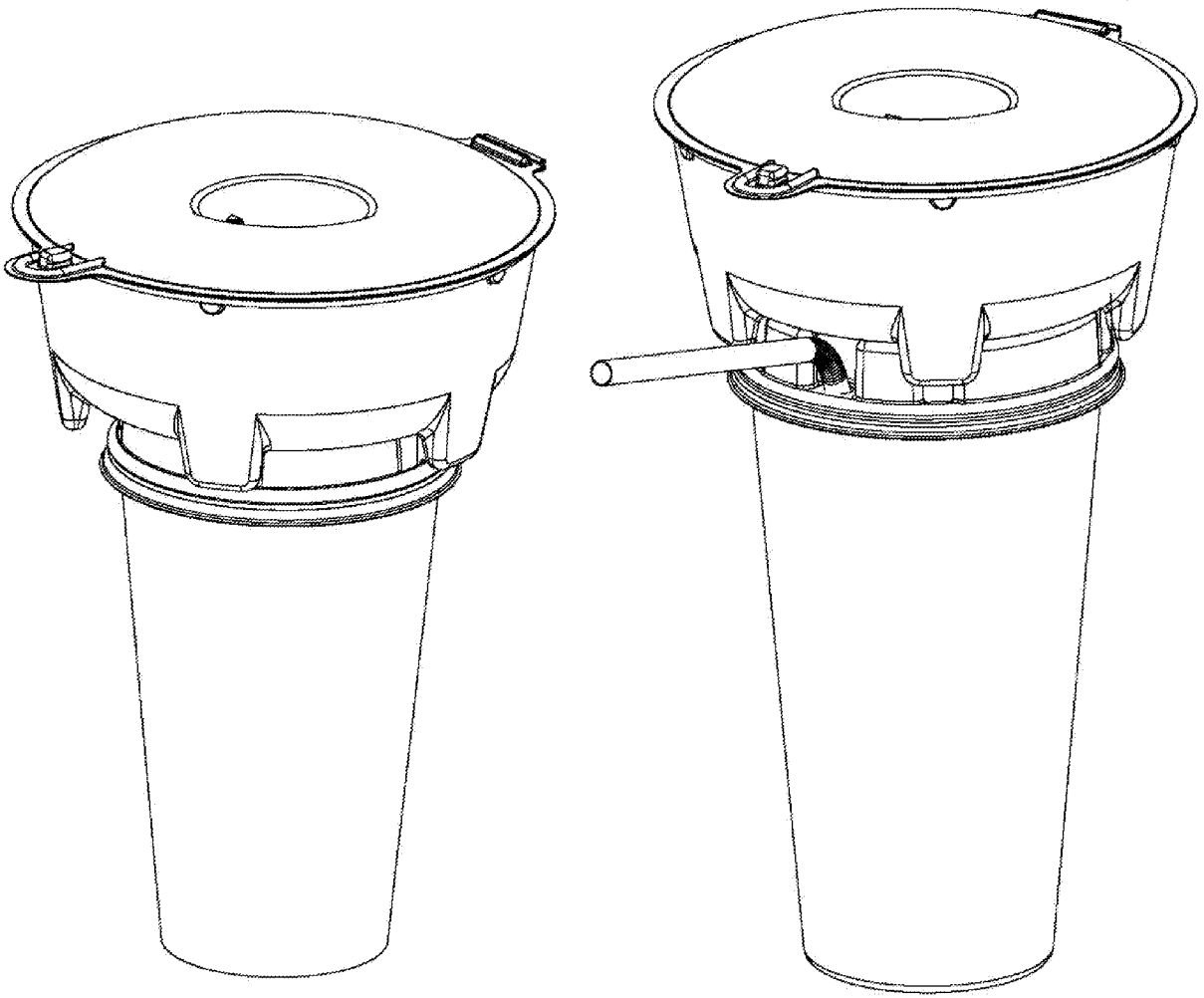
FIG. 11 is an isometric view of novel lid system of FIG. 6 attached to two cups of different heights.

FIG. 10 illustrates the hinge 325 in greater detail. The top cover 40 may have a latch structure 330 and the food container 30 may include a complementary latch structure 340. When the top cover 40 is closed, the latch structure 330 mates with the complementary latch structure 340, securing the top cover 40 closed.

The top cover 40 may also have a secondary latch structure 350 at the front leading edge (i.e. adjacent to the straw/sip hole) of the top cover 40 that is located opposite to the hinge 325. Likewise, the food container portion may have a secondary complementary latch structure 360 at the front leading edge (i.e. adjacent to the straw/sip hole) of the food container portion 30 that is located opposite to the hinge 325. When the top cover 40 is closed, the secondary latch structure 350 mates with the secondary complementary latch structure 360, securing the top cover 40 closed.

Shown in greater detail in FIGS. 19A through 20C are two embodiments of the secondary latch structures 350 and secondary complementary latch structures 360. In the FIG. 19A, the secondary latch structures 350 is shown mated with the secondary complementary latch structure 360. The secondary latch structure 350 includes an overhang 370 that extends past the secondary complementary latch structure 360, allowing the user to lift the top cover 40 by the overhang 370 and open the top cover 40. (see also FIGS. 13B and 17) FIGS. 19B and 19C illustrate the secondary complementary latch structure 360 with a single protrusion 380 that mates with a complementary structure on the secondary latch structure 350. The single protrusion 380 may also contain a bump 382 that further exerts pressure on the complementary structure on the secondary latch structure 350.

Figure 20A:
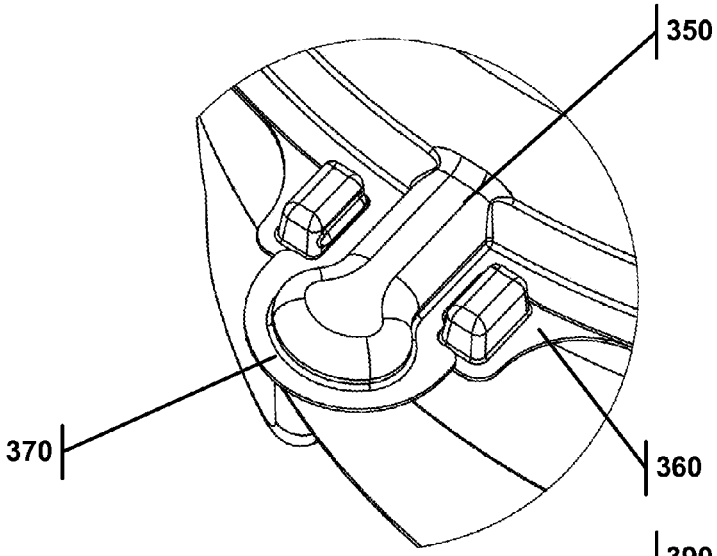
FIG. 20A is an isometric view of second embodiment of a latch structure to keep the top cover closed.
Figure 20B:
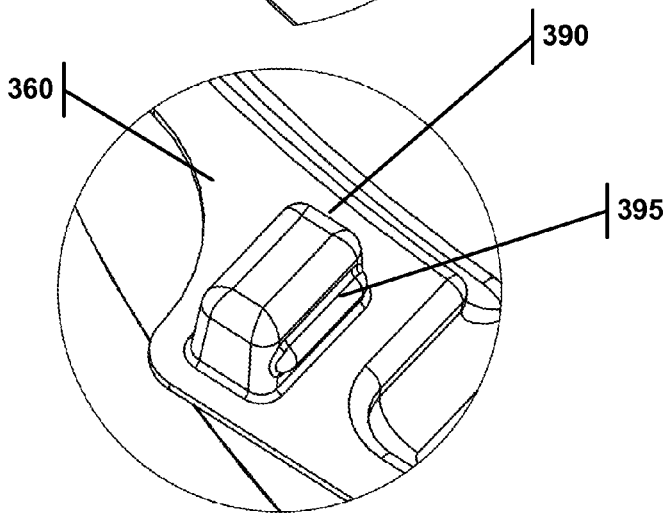
FIG. 20B is an isometric view of the latch structure of FIG. 20A.
Figure 20C:
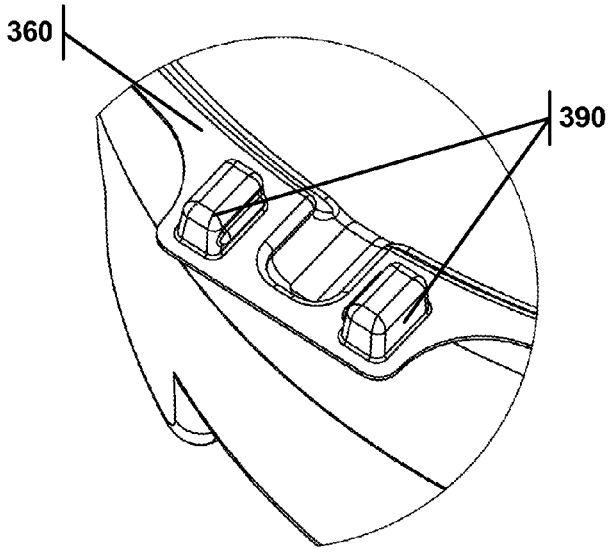
FIG. 20C is an isometric view of the latch structure of FIG. 20A.

In the FIG. 20A, the secondary latch structure 350 is shown mated with the secondary complementary latch structure 360. The secondary latch structure 350 includes an overhang 370 that extends past the secondary complementary latch structure 360, allowing the user to lift the top cover 40 by the overhang 370 and open the top cover 40. FIGS. 20B and 20C illustrate the secondary complementary latch structure 360 with a pair of protrusions 390 that flank the secondary latch structure 350 and secure the top cover 40 closed. The flanking protrusions 390 may also have a bump 395 under which the secondary latch structure 350 is disposed when the top cover 40 is closed. This is shown in FIG. 20A.

Figure 12A:
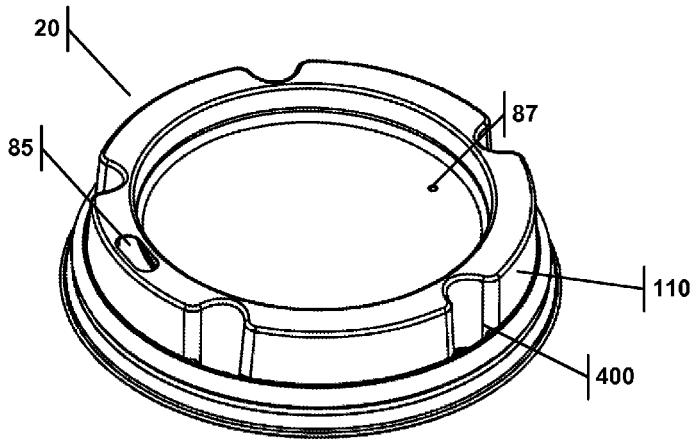
FIG. 12A is an isometric top view of an embodiment of a lid portion with a sip hole, further illustrating the fastening indents.
Figure 12B:
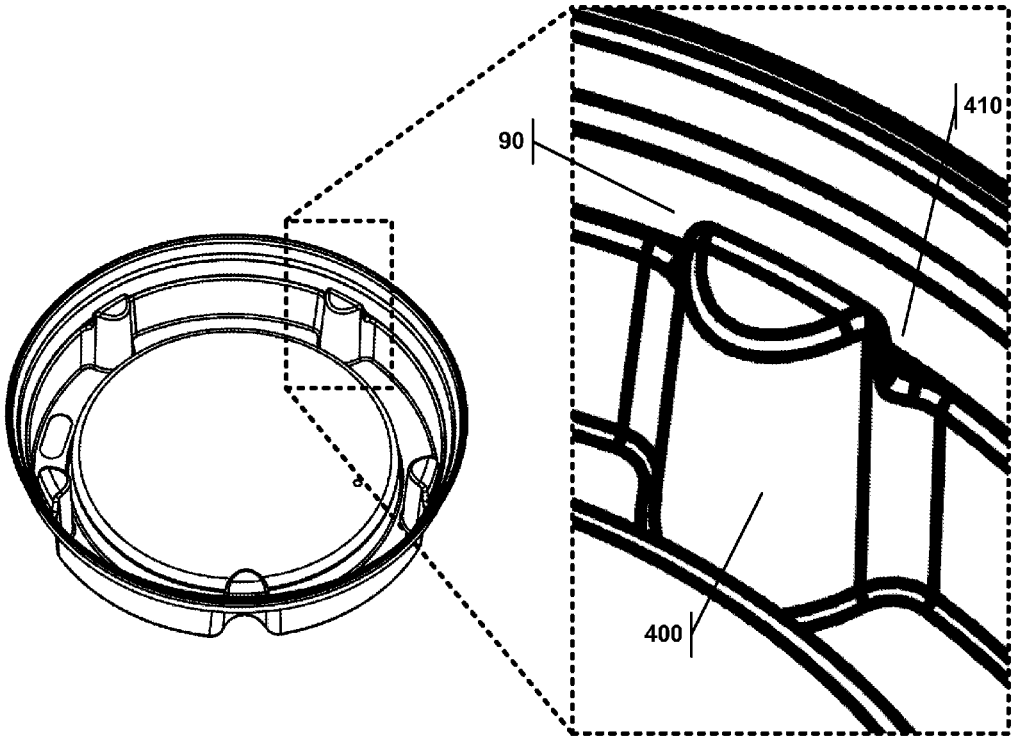
FIG. 12B is an isometric bottom view of lid portion of FIG. 12A.

FIG. 12A illustrates a lid portion 20 with a sip/gulp hole 85 and a vent 87 to relieve pressure when a user sips the beverage. Along the outer lid portion riser wall 110 are several optional secure fastening indents 400. These indents 400 help secure the lid portion to the rim 6 of the beverage container 5. This is shown in greater detail in FIG. 12B (where the lid portion 20 is flipped bottom side up) which shows an enlargement of one of these indents 400. The indent 400 extends below the position where the rim 6 of the beverage container 5 would mate with the coupling trough 90 (shown in FIG. 12B as position 410), so when the lid portion 20 mates with the rim 6 of the beverage container 5, the rim 6 is secured on the outside by the coupling trough 90 and on the inside by the secure fastening indent 400.

Figure 12C:
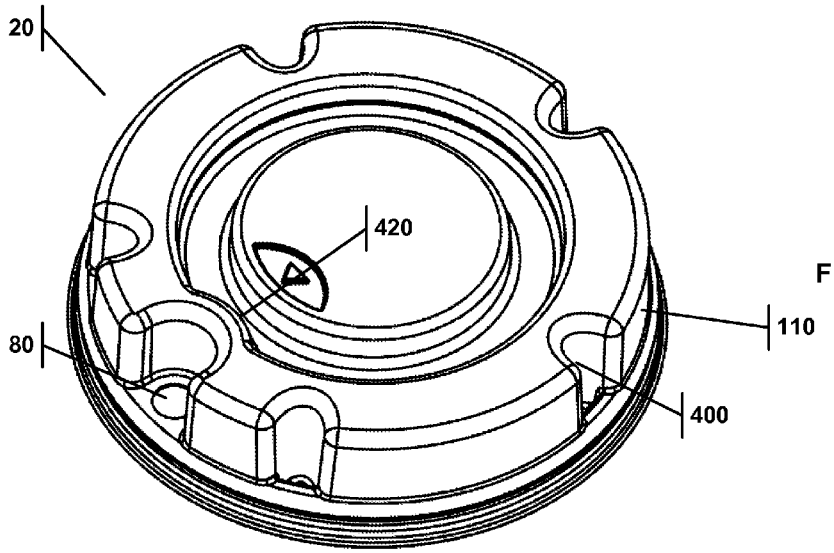
FIG. 12C is an isometric top view of an embodiment of a lid portion with a straw hole, further illustrating the fastening indents.
Figure 12D:
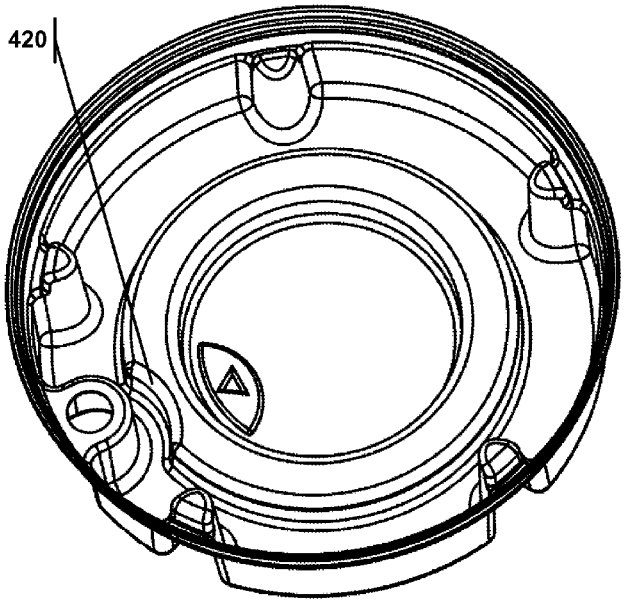
FIG. 12D is an isometric bottom view of lid portion of FIG. 12C.
Figure 13A:
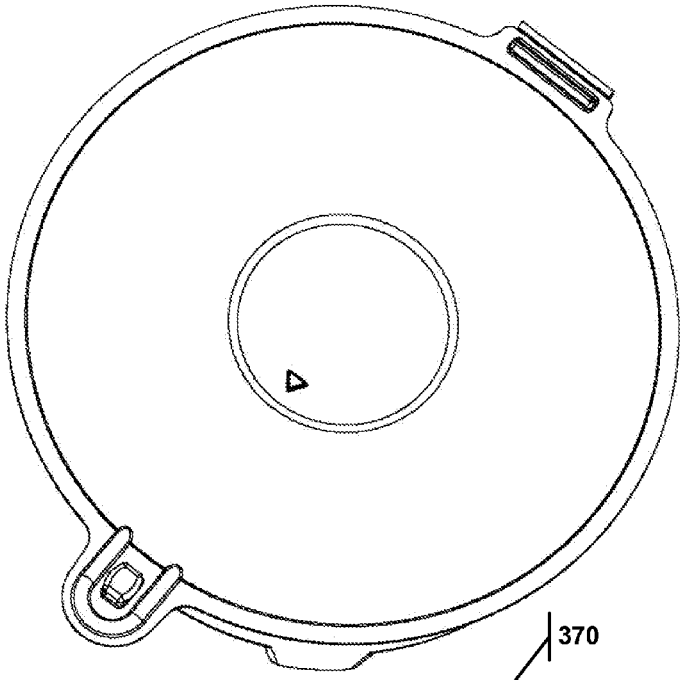
FIG. 13A is an isometric top view of the food container portion and top cover of the novel lid system of FIG. 6.
Figure 13B:
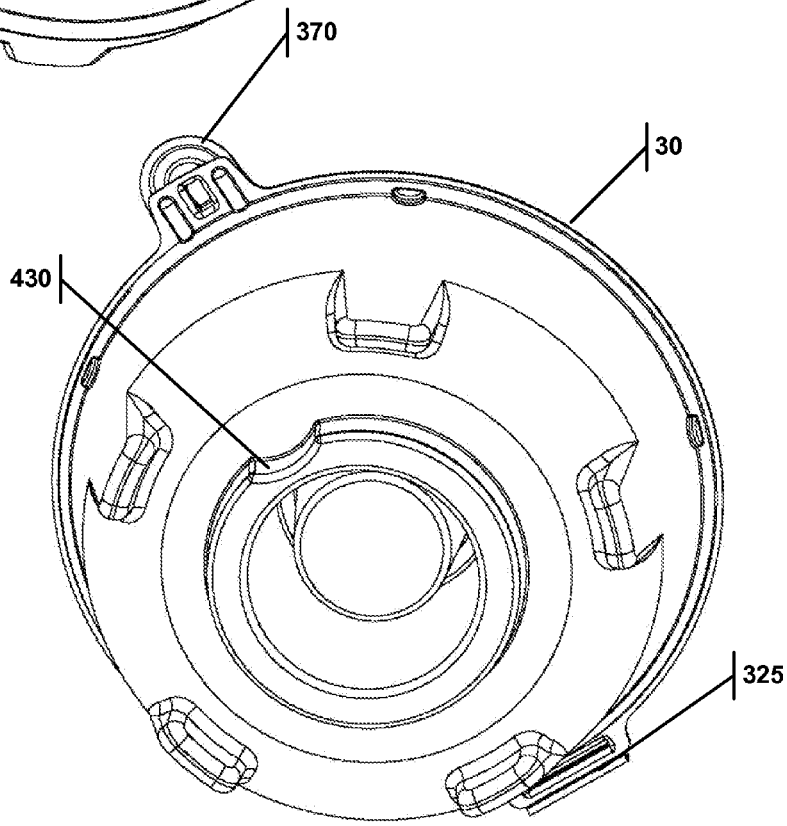
FIG. 13B is an isometric bottom view of the food container portion and top cover of the novel lid system of FIG. 6.
Figure 14:
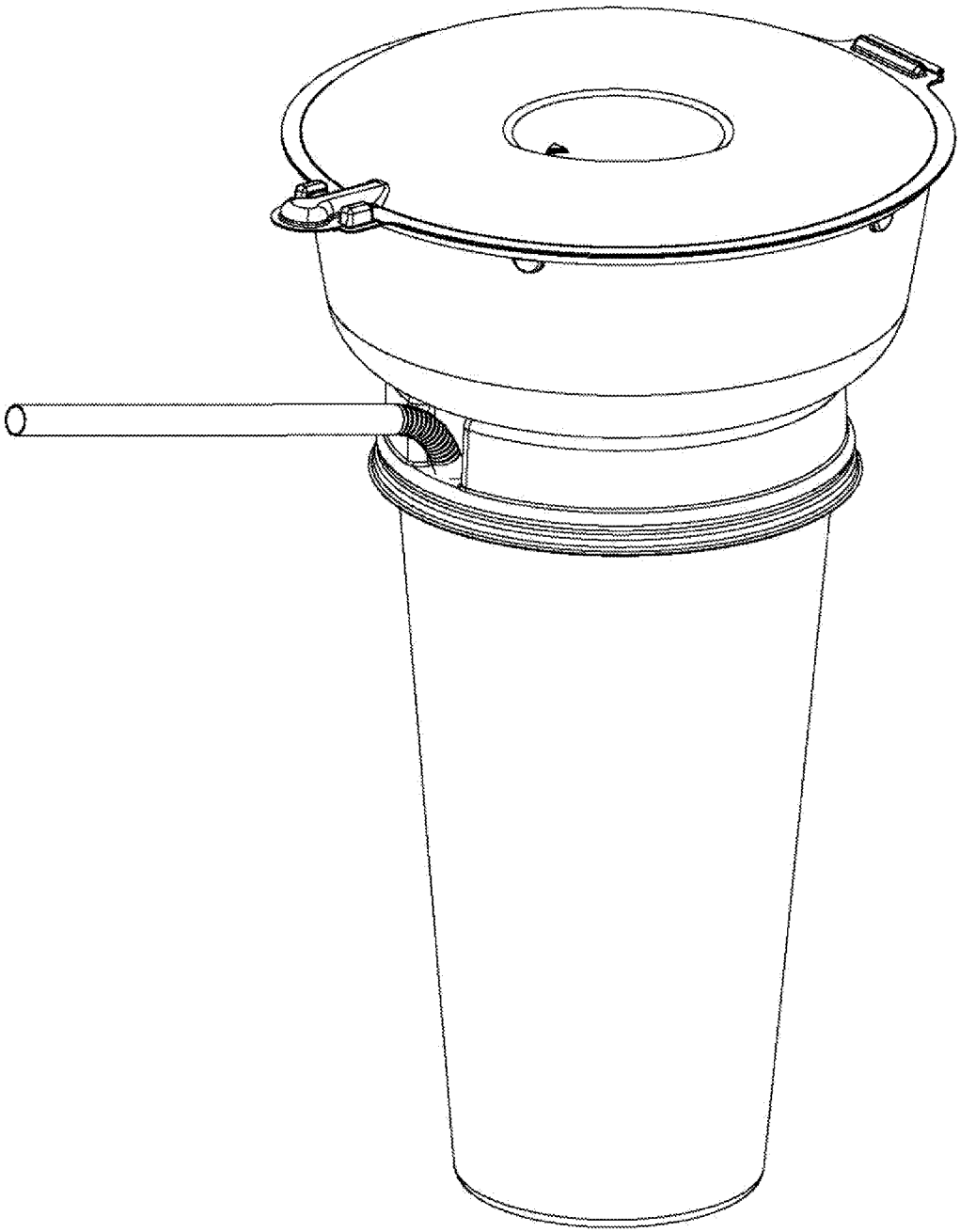
FIG. 14 is an isometric view of a third embodiment of a novel container lid system with a lid portion, food container portion and a hinged top cover, where the food container portion does not have leg posts.
Figure 15:
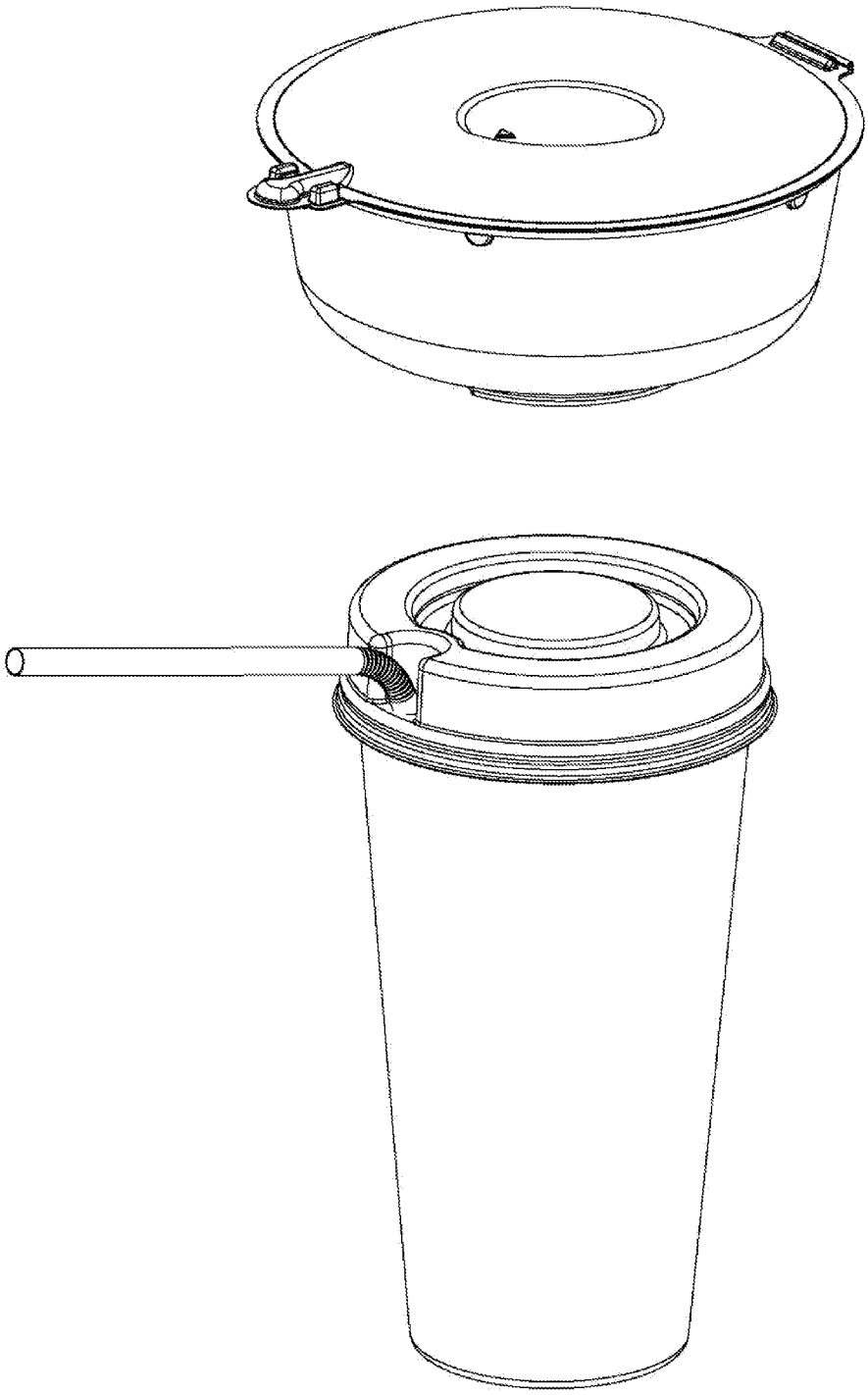
FIG. 15 is an isometric view of the novel lid system of FIG. 14 with the food container portion detached from the lid portion.
Figure 18:
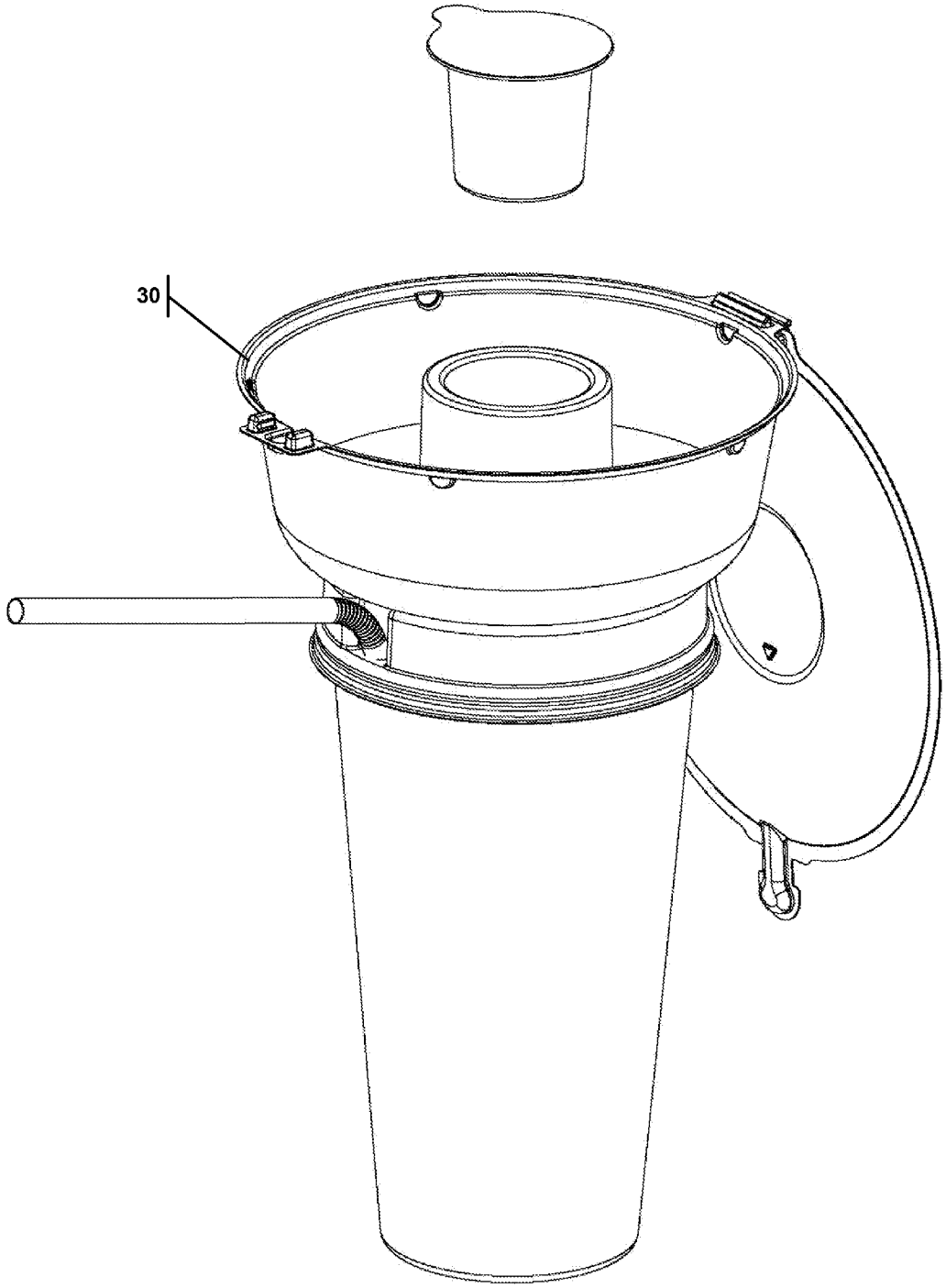
FIG. 18 is an isometric view of the novel lid system of FIG. 14, with the top cover hinged open and a condiment package.
Figure 19A:
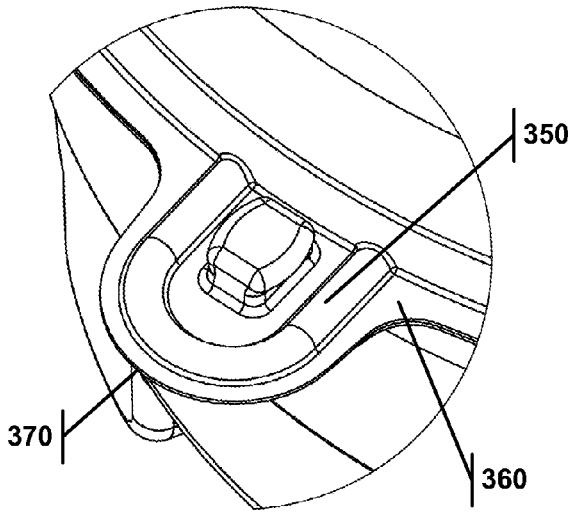
FIG. 19A is an isometric view of one embodiment of a latch structure to keep the top cover closed.
Figure 19B:
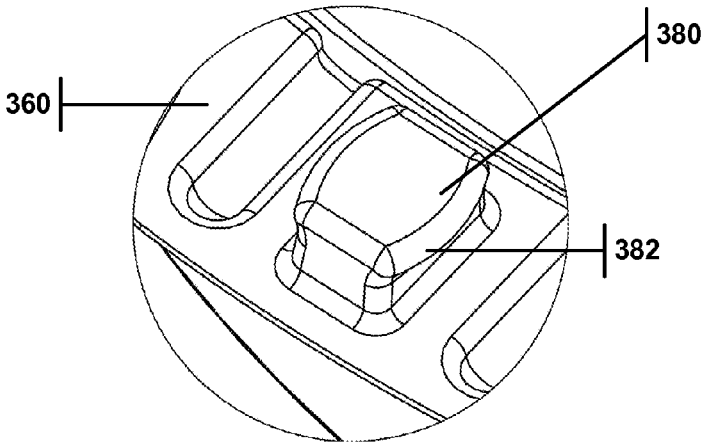
FIG. 19B is an isometric view of the latch structure of FIG. 19A.
Figure 19C:
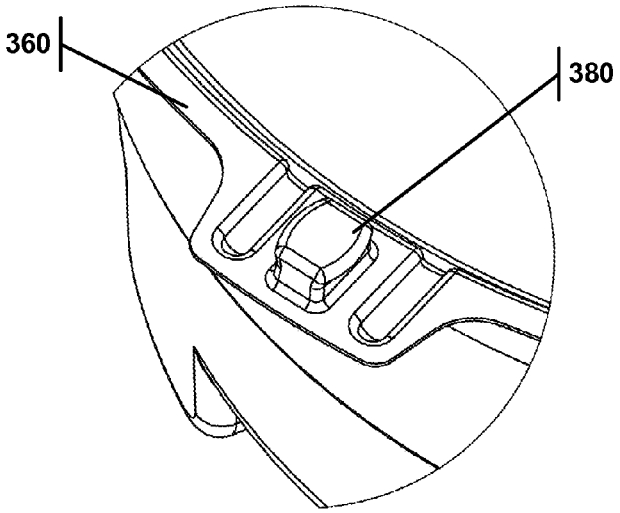
FIG. 19C is an isometric view of the latch structure of FIG. 19A.

FIG. 12C illustrates a lid portion 20 with a straw hole 80. Along the outer lid portion riser wall 110 are several secure fastening indents 400 that operate in the same fashion as just described. These fastening indents 400 may also operate as alignment structures that restrict the position of the food container portion 30 relative to the lid portion 20 when the food container portion 30 mates to the lid portion 20. The inner lid portion riser wall 130 may also (or alternatively) have an alignment structure 420 that restricts the position of the food container portion 30 relative to the lid portion 20 when the food container portion 30 mates to the lid portion 20. The food container portion 30 may also have an alignment structure 430, as shown in FIG. 13B. The alignment structures (400, 420, 430) allow the food container portion 30 to mate with the lid portion 20 in only one position. That position shown in the embodiment of FIGS. 12C, 12D and 13B is where the hinge 325 is located opposite to the location of the straw hole 80, such that the top cover 40 may be opened and would not obstruct a user from sipping on the straw. This is shown in FIG. 10.

FIGS. 14 through 18 illustrate a third embodiment of the present invention. Many of the structures already discussed are incorporated into this embodiment. A major difference with this embodiment is that the food container portion 30 does not have leg posts.

The lid portion 20, the food container portion 30 and the top cover 40 can be manufactured using a variety of conventional techniques, including but not limited to thermoforming. Thermoforming is a manufacturing process where a plastic sheet is heated to a pliable forming temperature, formed to a specific shape via a mold, and trimmed to create a usable product. The sheet is heated in an oven-type structure to a high-enough temperature that it can be formed via a mold at which point the formed part is cooled, thereby retaining its finished shape. Thermoforming is a reliable and inexpensive manufacturing process that is utilized for many conventional single-use food packaging containers.

Each of the three pieces—i.e., lid portion 20, the food container portion 20 and the top cover 40 of FIGS. 1-5D—are monolithic, meaning that they are created by a single and uniform sheet of plastic. In the second and third embodiments described with reference to FIGS. 6 through 18, the food container portion 20 and the top cover 40 may be a single monolithic piece.

This also allows these pieces to be made from different materials. For example, the lid portion 20 may be an opaque black so as to visually mask the flow of the beverage (like coffee). The food container portion 30 may be an opaque white which provides a more visually appealing presentation of the food within the food container cavity 70. And the top cover 40 may be constructed of transparent plastic, allowing the user to visually verify that the food contained in the food container cavity 70 is indeed what was ordered.

The types of material would be apparent to one of skill in the art and may include by non-limiting example PP (polypropylene), PET (polyethylene terephthalate), CPET, RPET Polyethylene (HDPE/LDPE), styrene, HIPS, HMWPE, PP/PE blends, custom blends of thermoplastics (which may or may not include post-consumer or post-industrial content) and other proprietary blends of thermoplastics.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend that the following claims "and the embodiments in the specification to be strictly coextensive." Phillips v. AHW Corp., 415 F.3d 1303, 1323 (Fed. Cir. 2005) (en banc).

The invention claimed is:

1. A container lid system comprising:

a lid portion comprising:

a coupling trough for attachment to the rim a beverage container adapted to form a liquid-tight seal with the beverage container;

an outer lid portion riser wall connected to the coupling trough, the outer lid portion riser wall extending away from the coupling trough, and wherein the outer lid portion riser wall defines a first lid portion surface that is generally orthogonal to the outer lid portion riser wall;

an inner lid portion riser wall connected to the first lid portion surface, the inner lid portion riser wall extending generally orthogonally away from the first lid potion surface and defining a second lid portion surface that is generally orthogonal to the inner lid portion riser wall;

a food container portion comprising:

a first food container surface;

an inner food container riser wall connected to the first food container surface, the inner food container riser wall extending generally orthogonally away from the first food container surface and defining a second food container surface that is generally orthogonal to the inner food container riser wall;

an outer food container riser wall connected to the second food container surface, the outer food container riser wall extending generally orthogonally away from the second food container surface and defining a food container cavity;

a condiment receiver structure extending away from the first food container surface;

wherein the inner lid portion riser wall and the first lid portion surface define a lid portion cross section perpendicular to the first lid portion surface; and wherein the inner food container riser wall and the second food container surface define a food container cross section perpendicular to the second food container surface;

the lid portion cross section substantially complementary to the food container cross section, such that the food container portion may snuggly mate with the lid portion.

2. The container lid system of claim 1, wherein the food container portion further comprising a hinge connected to a top cover, wherein the top cover covers the food container cavity.

3. The container lid system of claim 2, wherein the top cover comprising a latch structure and the food container comprises a complementary latch structure, and wherein the latch structure and the complementary latch structure mate with each other when the top cover is closed.

4. The container lid system of claim 3, wherein the complementary latch structure further comprises at least two structures that flank the latch structure.

5. The container lid system of claim 1, wherein the lid portion further comprising a sip/gulp hole.

6. The container lid system of claim 1, wherein the lid portion further comprising a straw hole.

7. The container lid system of claim 1, wherein the outer lid portion riser wall further comprises at least one secure fastening indent.

8. The container lid system of claim 1, wherein the inner lid portion riser wall further comprises an alignment structure adapted to restrict the position of the food container portion relative to the lid portion when the food container portion is mated to the lid portion.

9. The container lid system of claim 1, wherein the lid portion further comprises an alignment structure adapted to restrict the position of the food container portion relative to the lid portion when the food container portion is mated to the lid portion.

10. The container lid system of claim 1, wherein the food container portion further comprises an alignment structure adapted to restrict the position of the food container portion relative to the lid portion when the food container portion is mated to the lid portion.

11. The container lid system of claim 1, wherein the outer food container riser wall further comprises a leg post, wherein the outer lid portion riser wall further defines the lid portion cross section, and wherein the leg post further defines the food container cross section.

12. The container lid system of claim 1, wherein the condiment receiver structure comprises:

an outer condiment receiver riser wall extending generally orthogonally away from the first food container surface, defining a condiment receiver surface that is generally orthogonal to the outer condiment receiver wall.

13. The container lid system of claim 12, wherein the condiment receiver surface comprises a hole adapted to receive a condiment package.

14. The container lid system of claim 12, further comprising an inner condiment receiver riser wall connected to the condiment receiver surface, the inner condiment receiver riser wall extending generally orthogonally away from the condiment receiver surface and connecting to a condiment receiver bottom.

15. The container lid system of claim 14, wherein the inner condiment receiver riser wall and the condiment receiver bottom define a condiment cavity, and the cavity is adapted to receive a condiment package/container or an unpackaged condiment.

16. The container lid system of claim 1, wherein the food container portion further comprising a cover coupling structure adjacent to the outer food container riser wall, the lid system further comprising a top cover that comprises a cover complementary coupling structure; and the cover complementary coupling structure is constructed to detachably mate with the cover coupling structure.

17. The container lid system of claim 16, wherein the top cover further comprises a grip handle.

18. The container lid system of claim 1, wherein the inner lid portion riser wall comprises an inner lid portion riser wall coupling structure, and wherein the inner food container riser wall comprises an inner food container riser wall coupling structure constructed to detachably mate with the inner lid portion riser wall coupling structure.

19. The container lid system of claim 1, a lid portion further comprising:

a second inner lid portion riser wall connected to second lid portion surface, the second inner lid portion riser wall extending generally orthogonally away from the second lid potion surface and defining a third lid portion surface that is generally orthogonal to the second inner lid portion riser wall;

wherein the second inner lid portion riser wall and the third lid portion surface further defines the lid portion cross section; and wherein the condiment receiver structure further defines the food container cross section.

20. The container lid system of claim 19, wherein the second inner lid portion riser wall ascends such that the third lid portion surface is above the second lid portion surface.

21. The container lid system of claim 1, further comprising a condiment container constructed to mate with the condiment receiver structure.

* * * * *